US009933799B2

(12) United States Patent
Yang et al.

(10) Patent No.: US 9,933,799 B2
(45) Date of Patent: Apr. 3, 2018

(54) VOLTAGE REGULATOR USING A MULTI-POWER AND GAIN-BOOSTING TECHNIQUE AND MOBILE DEVICES INCLUDING THE SAME

(71) Applicant: SAMSUNG ELECTRONICS CO., LTD., Suwon-si, Gyeonggi-do (KR)

(72) Inventors: Jun Hyeok Yang, Seongnam-si (KR); Dae Yong Kim, Seoul (KR); Sang Ho Kim, Suwon-si (KR); Jae Jin Park, Seongnam-si (KR)

(73) Assignee: SAMSUNG ELECTRONICS CO., LTD., Suwon-si, Gyeonggi-Do (KR)

( * ) Notice: Subject to any disclaimer, the term of this patent is extended or adjusted under 35 U.S.C. 154(b) by 0 days.

(21) Appl. No.: 15/271,680

(22) Filed: Sep. 21, 2016

(65) Prior Publication Data

US 2017/0083034 A1 Mar. 23, 2017

Related U.S. Application Data

(60) Provisional application No. 62/221,849, filed on Sep. 22, 2015.

(30) Foreign Application Priority Data

Dec. 17, 2015 (KR) ..... 10-2015-0181279

(51) Int. Cl.
*G05F 1/575* (2006.01)

(52) U.S. Cl.
CPC ..... *G05F 1/575* (2013.01)

(58) Field of Classification Search
CPC . G05F 1/56; G05F 1/563; G05F 1/575; G05F 3/24; G05F 3/30; H02M 3/156–3/158; H02M 3/1584; H02M 3/1588; H02M 2001/007; H02M 2001/009; H02M 2001/0032; H02M 2001/0045; Y02B 70/1466
USPC ..... 323/265–268, 270, 271, 273, 280–282
See application file for complete search history.

(56) References Cited

U.S. PATENT DOCUMENTS

| | | | |
|---|---|---|---|
| 6,690,147 | B2 | 2/2004 | Bonto |
| 6,897,715 | B2 | 5/2005 | Barber, Jr. et al. |
| 7,235,959 | B2 | 6/2007 | Sicard |
| 7,298,567 | B2 | 11/2007 | Poss |

(Continued)

FOREIGN PATENT DOCUMENTS

| | | |
|---|---|---|
| KR | 1020100091406 | 8/2010 |
| KR | 1020110078479 | 7/2011 |
| KR | 10-1238173 | 2/2013 |

*Primary Examiner* — Yemane Mehari
(74) *Attorney, Agent, or Firm* — F. Chau & Associates, LLC

(57) ABSTRACT

A voltage regulator includes an error amplifier configured to receive a first voltage through a first node as an operating voltage, to amplify a difference between a reference voltage and a feedback voltage, and to output an amplified voltage; a power transistor connected between a second node through which a second voltage is supplied and an output node of the voltage regulator; and a switch circuit configured to select a level of a gate voltage supplied to a gate of the power transistor and level of a body voltage supplied to a body of the power transistor in response to a first power sequence of the first voltage, a second power sequence of the second voltage, and an operation control signal.

20 Claims, 19 Drawing Sheets

(56) References Cited

U.S. PATENT DOCUMENTS

| | | | | |
|---|---|---|---|---|
| 7,639,067 | B1 | 12/2009 | Perisetty | |
| 7,656,139 | B2 | 2/2010 | Van Ettinger | |
| 8,305,066 | B2 | 11/2012 | Lin et al. | |
| 8,536,845 | B2 | 9/2013 | Kim et al. | |
| 2004/0140845 | A1 | 7/2004 | Eberlein | |
| 2005/0189934 | A1* | 9/2005 | Poss | G05F 1/575 323/316 |
| 2009/0033310 | A1* | 2/2009 | Erbito, Jr. | G05F 1/56 323/313 |
| 2011/0095737 | A1 | 4/2011 | Chu et al. | |
| 2012/0013396 | A1* | 1/2012 | Morino | G05F 3/24 327/540 |
| 2013/0200870 | A1 | 8/2013 | Pradhan | |
| 2015/0233996 | A1* | 8/2015 | Yoon | G01R 31/2851 324/509 |

* cited by examiner

VOLTAGE REGULATOR USING A MULTI-POWER AND GAIN-BOOSTING TECHNIQUE AND MOBILE DEVICES INCLUDING THE SAME

CROSS-REFERENCE TO RELATED APPLICATIONS

This application claims priority under 35 U.S.C. § 119(e) to U.S. Provisional Patent Application No. 62/221,849 filed on Sep. 22, 2015, and under 35 U.S.C. § 119(a) to Korean Patent Application No. 10-2015-0181279 filed on Dec. 17, 2015, the disclosures of which are incorporated by reference herein in their entireties.

TECHNICAL FIELD

Exemplary embodiments of the inventive concept relate to a voltage regulator, and more particularly, to a voltage regulator using multi-power and gain-boosting techniques and mobile devices including the same.

DISCUSSION OF RELATED ART

A mobile device can be operated for an extended period of time without having to recharge its battery due to increases in battery efficiency.

A mobile device may include a low-dropout (LDO) regulator. The LDO regulator receives an operating voltage from a power management integrated circuit (IC) included in the mobile device and converts the operating voltage into a voltage used by a semiconductor chip included in the mobile device. The LDO regulator secures a dropout voltage, e.g., a difference between an input voltage and an output voltage, to correctly generate the output voltage.

However, when the dropout voltage is too small, the overall feedback loop gain of the LDO regulator decreases. As a result, a large error occurs in the output voltage of the LDO regulator.

When an LDO regulator is supplied with a power voltage from a power management IC through power lines, an input voltage of the LDO regulator may not equal an output voltage of the power management IC. This is so, because of a voltage drop of the power lines. Accordingly, as the input voltage of the LDO regulator decreases, a dropout voltage approaches 0. In this case, the overall feedback loop gain of the LDO regulator is so low that the LDO regulator may not operate normally.

SUMMARY

According to an exemplary embodiment of the inventive concept, there is provided a voltage regulator including an error amplifier configured to receive a first voltage through a first node as an operating voltage, to amplify a difference between a reference voltage and a feedback voltage, and to output an amplified voltage; a power transistor connected between a second node through which a second voltage is supplied and an output node; and a switch circuit configured to select a level of a gate voltage supplied to a gate of the power transistor and a level of a body voltage supplied to a body of the power transistor in response to a first power sequence of the first voltage, a second power sequence of the second voltage, and an operation control signal.

According to an exemplary embodiment of the inventive concept, there is provided a mobile device including a voltage regulator and a power management integrated circuit configured to supply a first voltage to the voltage regulator through a first transmission line and to supply a second voltage to the voltage regulator through a second transmission line. The voltage regulator includes an error amplifier configured to receive the first voltage through a first node connected to the first transmission line as an operating voltage, to amplify a difference between a reference voltage and a feedback voltage, and to output an amplified voltage; a power transistor connected between a second node connected to the second transmission line and an output node of the voltage regulator; and a switch circuit configured to select a level of a gate voltage supplied to a gate of the power transistor and a level of a body voltage supplied to a body of the power transistor in response to a first power sequence of the first voltage, a second power sequence of the second voltage, and an operation control signal.

According to an exemplary embodiment of the inventive concept, there is provided a mobile device including a memory, a memory controller including a voltage regulator, and a power management integrated circuit configured to supply a first voltage and a second voltage to the voltage regulator and to supply a third voltage to the memory. The voltage regulator includes an error amplifier configured to receive the first voltage through a first node as an operating voltage, to amplify a difference between a reference voltage and a feedback voltage, and to output an amplified voltage; a power transistor connected between a second node receiving the second voltage and an output node of the voltage regulator; and a switch circuit configured to select a level of a gate voltage supplied to a gate of the power transistor and a level of a body voltage supplied to a body of the power transistor in response to a first power sequence of the first voltage, a second power sequence of the second voltage, and an operation control signal. The first voltage may be higher than the second voltage.

According to an exemplary embodiment of the inventive concept, there is provided a power transistor configured to output an output voltage of the voltage regulator; and a switch circuit configured provide a first voltage or a second voltage to a gate of the power transistor in response to at least one control signal and a level of each of the first and second voltages, and to provide the first voltage or the second voltage to a body of the power transistor in response to the at least one control signal and the level of each of the first and second voltages.

BRIEF DESCRIPTION OF THE DRAWINGS

The above and other features of the inventive concept will become more apparent by describing in detail exemplary embodiments thereof with reference to the attached drawings in which.

DETAILED DESCRIPTION OF THE EMBODIMENTS

Figure 1:
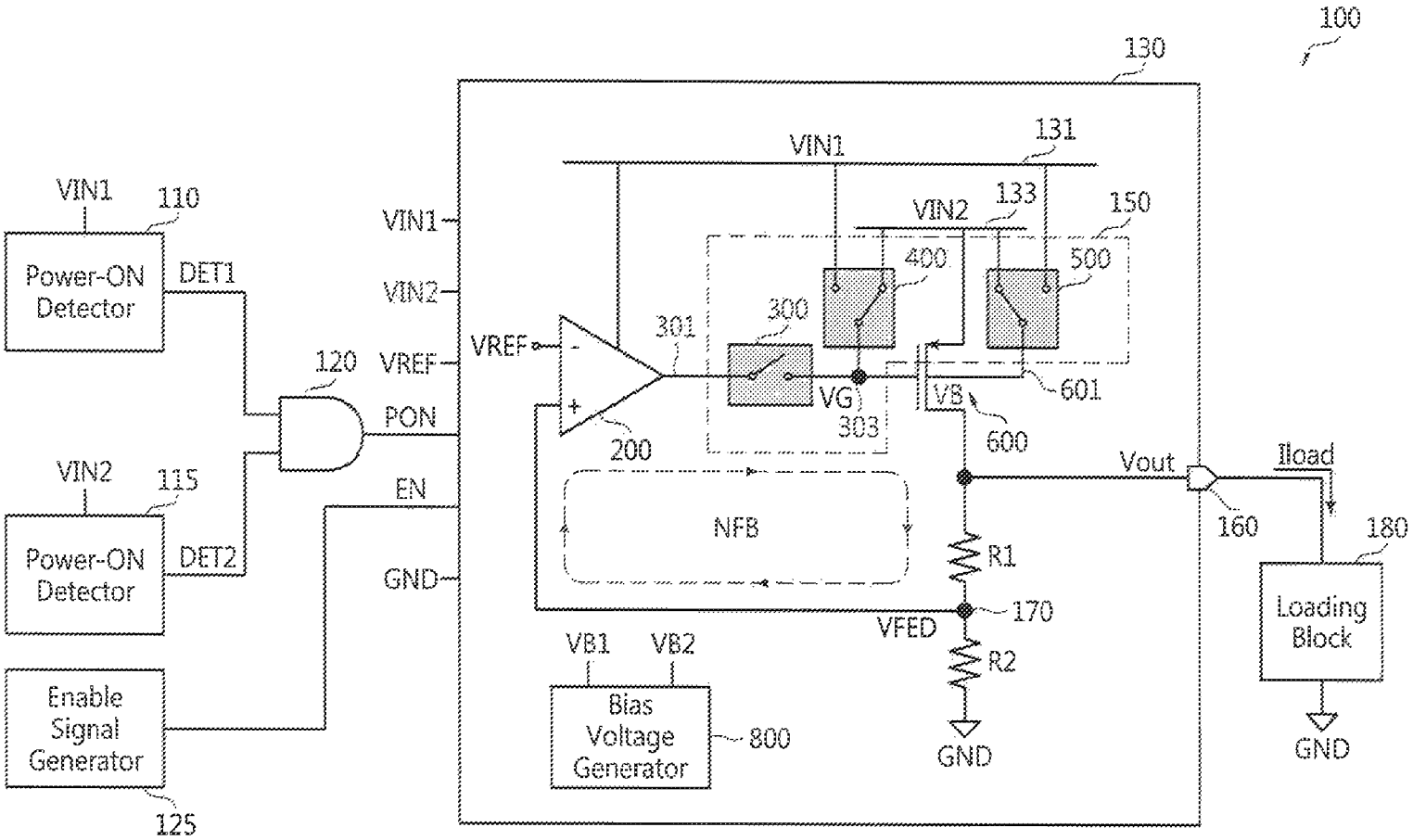
FIG. 1 is a block diagram of an integrated circuit (IC) according to an exemplary embodiment of the inventive concept.

FIG. 1 is a block diagram of an integrated circuit (IC) 100 according to an exemplary embodiment of the inventive concept. The IC 100 may include a first power-on detector 110, a second power-on detector 115, a logic gate circuit 120, an enable (or operation control) signal generator 125, a voltage regulator 130, and a loading block 180. Hereinafter, power may refer to an operating voltage. The IC 100 may be a semiconductor chip, a processor, an application processor, a system on chip (SoC), a memory controller, a display driver IC (DDI), or a smart card but is not limited thereto.

The first power-on detector 110 may detect the level of a first voltage VIN1 and generate a first detection signal DET1. The second power-on detector 115 may detect the level of a second voltage VIN2 and generate a second detection signal DET2. For example, the maximum level (e.g., 1.8 V) of the first voltage VIN1 may be higher than the maximum level (e.g., 1.2 V) of the second voltage VIN2, but the inventive concept is not limited thereto. For example, when the first voltage VIN1 is fully powered up to 1.8 V, the first power-on detector 110 may generate the first detection signal DET1 at a high level (or logic 1). When the second voltage VIN2 is fully powered up to 1.2 V, the second power-on detector 115 may generate the second detection signal DET2 at a high level (or logic 1).

A first voltage which enables the detection signals DET1 and DET2 to transition from a low level (or logic 0) to the high level (or logic 1) and a second voltage which enables the detection signals DET1 and DET2 to transition from the high level to the low level may be variously modified according to design specifications. For example, when the first voltage VIN1 is a little lower than 1.8 V, the first power-on detector 110 may generate the first detection signal DET1 at the high level. When the second voltage VIN2 is a little lower than 1.2 V, the second power-on detector 115 may generate the second detection signal DET2 at the high level.

The logic gate circuit 120 may perform an AND operation on the first detection signal DET1 and the second detection signal DET2 to generate a power-on signal PON. For example, the logic gate circuit 120 may be an AND gate circuit. When both the first voltage VIN1 and the second voltage VIN2 are fully powered-up, the logic gate circuit 120 may generate the power-on signal PON at a high level.

The enable signal generator 125 may generate an operation control signal EN for controlling the operation of the voltage regulator 130. For example, when the operation control signal EN is at a low level or is disabled, the voltage regulator 130 may operate in a sleep mode or a power save mode. When the operation control signal EN is at a high level or is enabled, the voltage regulator 130 may operate in an active mode or a normal mode.

The voltage regulator 130 may receive the first voltage VIN1 and the second voltage VIN2 and may control the level of a gate voltage VG applied to a gate 303 of a power transistor 600 and the level of a body voltage VB applied to a body 601 of the power transistor 600 based on a first power sequence of the first voltage VIN1, a second poser sequence of the second voltage VIN2, and the operation control signal EN. The voltage regulator 130 may be a low-dropout (LDO) voltage regulator.

The voltage regulator 130 may include a first node (or line) 131 for the supply of the first voltage VIN1, a second node (or line) 133 for the supply of the second voltage VIN2, a switch circuit 150, an error amplifier 200, the power transistor 600, and resistors R1 and R2. The error amplifier 200, a first switch circuit 300, the power transistor 600, and the resistors R1 and R2 may form a negative feedback loop NFB. For example, the resistors R1 and R2 may form a feedback network.

The switch circuit 150 may select the level of the gate voltage VG applied to the gate 303 of the power transistor 600 and the level of the body voltage VB applied to the body 601 of the power transistor 600 based on the first power sequence of the first voltage VIN1, the second power sequence of the second voltage VIN2, and the operation control signal EN. Hereinafter, a configuration of elements included in the switch circuit 150 will be described in detail with reference to FIGS. 2 through 11. The switch circuit 150 may include the first switch circuit 300, a second switch circuit 400, and a third switch circuit 500. Operations of the switch circuits 300, 400, and 500 will be described in detail with reference to FIGS. 2 through 11.

The error amplifier 200 may use the first voltage VIN1 received through the first node 131 as an operating voltage and may amplify a difference between a reference voltage VREF and a feedback voltage VFED. The error amplifier 200 may be an operational (OP) amplifier.

The power transistor 600 is connected between the second node 133 supplying the second voltage VIN2 and an output node 160 of the voltage regulator 130. The power transistor 600 may be a P-channel metal-oxide semiconductor (PMOS) transistor. The resistors R1 and R2 may be connected in series between the output node (or output terminal) 160 of the voltage regulator 130 and a ground GND and may generate the feedback voltage VFED based on an output current of the power transistor 600.

A bias voltage generator 800 may generate bias voltages VB1 and VB2 applied to the error amplifier 200. Although the bias voltage generator 800 is placed inside the voltage regulator 130 in the embodiment illustrated in FIG. 1, the inventive concept is not limited thereto.

The loading block 180 may be a circuit (e.g., a digital logic circuit or an analog circuit) which operates in response to an output voltage Vout of the voltage regulator 130 but is not limited thereto.

Figure 2:
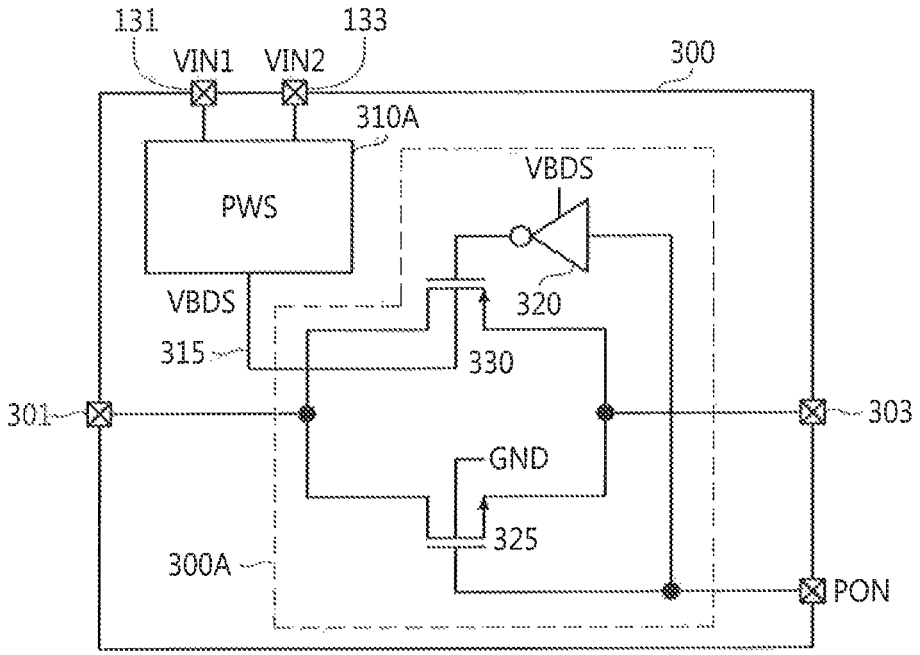
FIG. 2 is a diagram of a first switch circuit illustrated in FIG. 1 according to an exemplary embodiment of the inventive concept.

FIG. 2 is a diagram of the first switch circuit 300 illustrated in FIG. 1 according to an exemplary embodiment of the inventive concept. Referring to FIGS. 1 and 2, the first switch circuit 300 may disconnect an output node (or output terminal) 301 of the error amplifier 200 from the gate 303 of the power transistor 600 when the power-on signal PON is at a low level. The first switch circuit 300 may prevent leakage current from occurring in the power transistor 600 due to the first voltage VIN1 and the second voltage VIN2.

The first switch circuit 300 may include a power selector circuit 310A and a first selection circuit 300A. The first selection circuit 300A may include an inverter 320 and a plurality of MOS transistors 325 and 330. The first selection circuit 300A may perform functions the same as or similar to those of a transmission gate.

The voltage regulator 130 may use multi-power, e.g., the first voltage VIN1 and the second voltage VIN2, to use a gain-boosting technique. However, it may not be known when and how the first voltage VIN1 and the second voltage VIN2 will be supplied according to what product environment the voltage regulator 130 used in. The product environment may refer to a semiconductor chip including the voltage regulator 130, for example.

Accordingly, when the voltage regulator 130 using the multi-power VIN1 and VIN2 is integrated into a semiconductor chip, the voltage regulator 130 may block abnormal leakage current regardless of the first power sequence of the first voltage VIN1 and the second power sequence of the second voltage VIN2 by using the switch circuit 150. In other words, the switch circuit 150 may block abnormal leakage current flowing through the power transistor 600 regardless of the order in which the first voltage VIN1 and the second voltage VIN2 are supplied. In addition, the switch circuit 150 may block abnormal leakage current flowing through the power transistor 600 even when neither the first voltage VIN1 nor the second voltage VIN2 are supplied. The switch circuit 150 which uses an adaptive power switching (APS) technique may adaptively control a voltage of the gate (or gate electrode) 303 and a voltage of the body (or body electrode) 601 according to the level of the first voltage VIN1 and the level of the second voltage VIN2.

The power selector circuit 310A may output a higher one of the first voltage VIN1 and the second voltage VIN2 as an output voltage VBDS. Since the inverter 320 always operates regardless of the first power sequence of the first voltage VIN1 and the second power sequence of the second voltage VIN2, it may use the output voltage VBDS of the power selector circuit 310A as an operating voltage.

The inverter 320 is an example of a logic gate circuit. The transistor 325 may be an N-channel MOS (NMOS) transistor and a body of the NMOS transistor 325 may be connected to the ground GND. The transistor 330 may be a PMOS transistor and the output voltage VBDS may be supplied to a body of the PMOS transistor 330.

Figure 3:
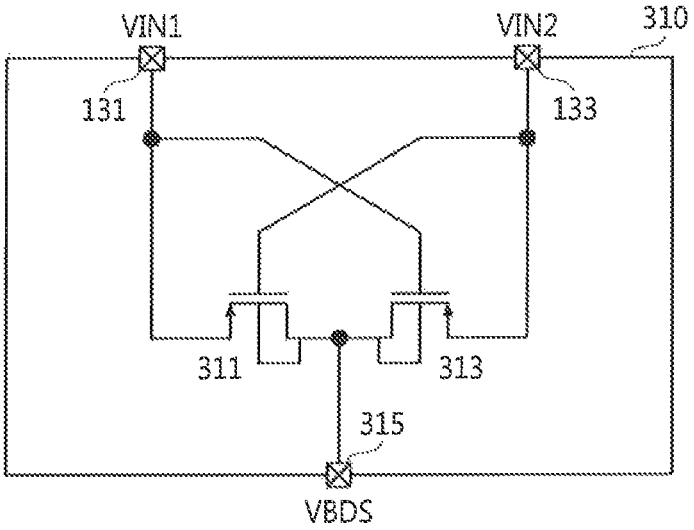
FIG. 3 is a diagram of a power selector circuit illustrated in FIG. 2 according to an exemplary embodiment of the inventive concept.

FIG. 3 is a diagram of the power selector circuit 310A illustrated in FIG. 2 according to an exemplary embodiment of the inventive concept. A power selector circuit denoted by 310A, 310B, 310C, and 310 is collectively denoted by 310. Referring to FIGS. 2 and 3, the power selector circuit 310 may include a first PMOS transistor 311 and a second PMOS transistor 313.

A gate of the first PMOS transistor 311 is connected to the second node 133 and a gate of the second PMOS transistor 313 is connected to the first node 131. A body and a drain of each of the PMOS transistors 311 and 313 are connected to an output node (or output terminal) 315 of the power selector circuit 310. For example, when the first voltage VIN1 supplied to the first node 131 is lower than the second voltage VIN2 supplied to the second node 133, the second PMOS transistor 313 is turned on, and therefore, the second voltage VIN2 higher than the first voltage VIN1 may be output as the output voltage VBDS through the output node 315.

In addition, when the second voltage VIN2 supplied to the second node 133 is lower than the first voltage VIN1 supplied to the first node 131, the first PMOS transistor 311 is turned on, and therefore, the first voltage VIN1 higher than the second voltage VIN2 may be output as the output voltage VBDS through the output node 315. In other words, the power selector circuit 310 may output a higher one of the first voltage VIN1 and the second voltage VIN2 as the output voltage VBDS.

Figure 4:
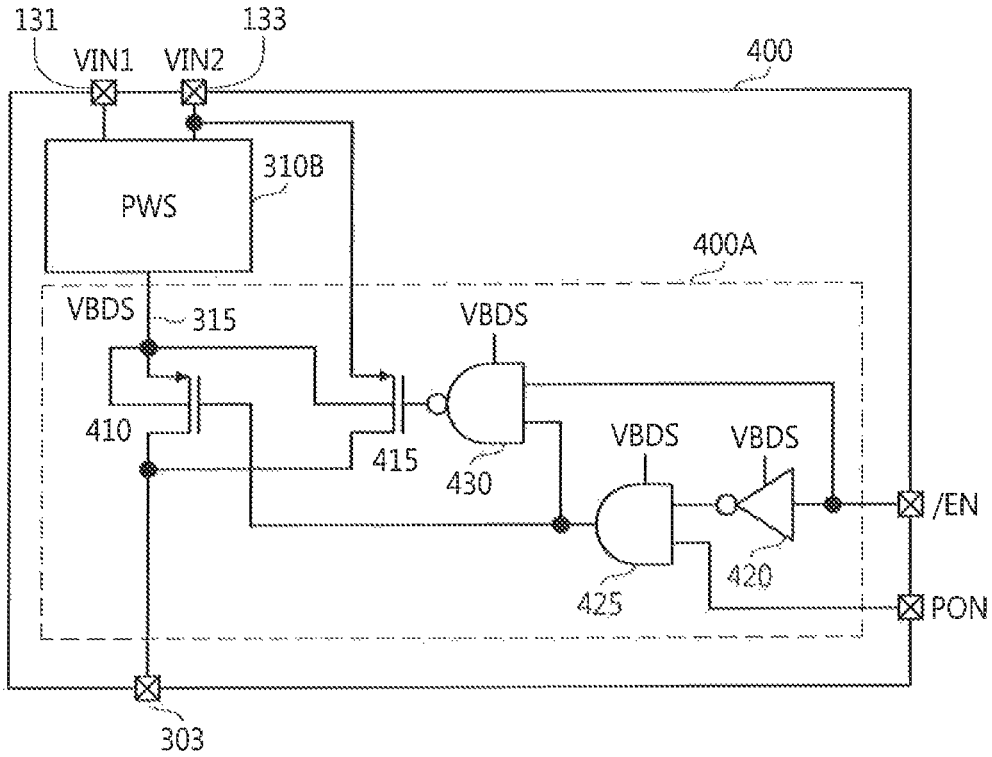
FIG. 4 is a diagram of a second switch circuit illustrated in FIG. 1 according to an exemplary embodiment of the inventive concept.

FIG. 4 is a diagram of the second switch circuit 400 illustrated in FIG. 1 according to an exemplary embodiment of the inventive concept. Referring to FIGS. 1 and 4, the second switch circuit 400 may control a voltage supplied to the gate 303 of the power transistor 600 in response to the first power sequence of the first voltage VIN1, the second power sequence of the second voltage VIN2, and the operation control signal EN.

When both of the first voltage VIN1 and the second voltage VIN2 are not fully powered up or when both of the first voltage VIN1 and the second voltage VIN2 are fully powered up and the operation control signal EN is at the low level, the second switch circuit 400 may supply a higher one of the first voltage VIN1 and the second voltage VIN2 to the gate 303 of the power transistor 600. As the higher one of the first voltage VIN1 and the second voltage VIN2 is supplied to the gate 303 of the power transistor 600, the power transistor 600 is turned off.

The second switch circuit 400 may include the power selector circuit 310B and a second selection circuit 400A. The structure and operations of the power selector circuit 310B illustrated in FIG. 4 are the same as those of the power selector circuit 310 illustrated in FIG. 3. Thus, detailed descriptions of the structure and operations of the power selector circuit 310B will be omitted.

The second selection circuit 400A may include an inverter 420, an AND gate 425, a NAND gate 430, and a plurality of PMOS transistors 410 and 415. The inverter 420 may use the output voltage VBDS of the power selector circuit 310B as an operating voltage and may invert an inverted operation control signal/EN. The elements 420, 425, and 430 may each be a logic gate circuit using the output voltage VBDS as an operating voltage.

The AND gate 425 may use the output voltage VBDS of the power selector circuit 310B as the operating voltage and may perform an AND operation on an output signal of the inverter 420 and the power-on signal PON. The NAND gate 430 may perform a NAND operation on the inverted operation control signal/EN and an output signal of the AND gate 425.

The PMOS transistor 410 is connected between the output node 315 and the gate 303 of the power transistor 600. The PMOS transistor 410 may be turned on or off in response to the output signal of the AND gate 425. The body of the PMOS transistor 410 may be connected to the output node 315. The PMOS transistor 415 is connected between the second node 133 and the gate 303 of the power transistor 600. The PMOS transistor 415 may be turned on or off in response to an output signal of the NAND gate 430. The body of the PMOS transistor 415 may be connected to the output node 315.

Figure 5:
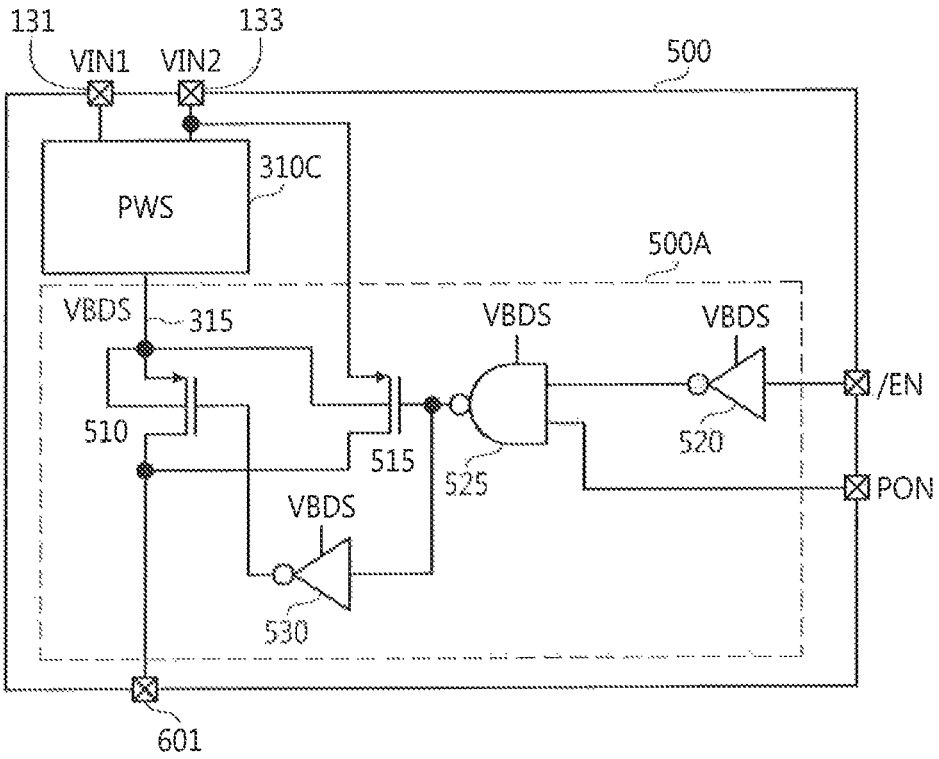
FIG. 5 is a diagram of a third switch circuit illustrated in FIG. 1 according to an exemplary embodiment of the inventive concept.

FIG. 5 is a diagram of the third switch circuit 500 illustrated in FIG. 1 according to an exemplary embodiment of the inventive concept. Referring to FIG. 5, the third switch circuit 500 may control the body voltage VB supplied to the body 601 of the power transistor 600 in response to the first power sequence of the first voltage VIN1, the second power sequence of the second voltage VIN2, and the inverted operation control signal/EN.

When the voltage regulator 130 is in the active mode (e.g., when the operation control signal EN is at the high level), the body 601 of the power transistor 600 is supposed to be connected to the second node 133. However, when either the power-on signal PON or the operation control signal EN is at the low level, the third switch circuit 500 supplies a higher one of the first voltage VIN1 and the second voltage VIN2 to the body 601 of the power transistor 600 and the second switch circuit 400 supplies the higher voltage to the gate 303 of the power transistor 600.

The third switch circuit 500 may include the power selector circuit 310C and a third selection circuit 500A. The structure and operations of the power selector circuit 310C illustrated in FIG. 5 are the same as those of the power selector circuit 310 illustrated in FIG. 3. Thus, detailed descriptions of the structure and operations of the power selector circuit 310C will be omitted.

The third selection circuit 500A may include a first inverter 520, a NAND gate 525, a second inverter 530, and a plurality of PMOS transistors 510 and 515. The first inverter 520 may use the output voltage VBDS of the power selector circuit 310C as an operating voltage and may invert the inverted operation control signal/EN. The elements 520, 525, and 530 may each be a logic gate circuit using the output voltage VBDS as an operating voltage.

The NAND gate 525 may use the output voltage VBDS of the power selector circuit 310C as the operating voltage and may perform a NAND operation on an output signal of the first inverter 520 and the power-on signal PON. The second inverter 530 may use the output voltage VBDS of the power selector circuit 310C as the operating voltage and may invert an output signal of the NAND gate 525.

The PMOS transistor 510 is connected between the output node 315 and the body 601 of the power transistor 600. The PMOS transistor 510 may be turned on or off in response to an output signal of the second inverter 530. The body of the PMOS transistor 510 may be connected to the output node 315. The PMOS transistor 515 is connected between the second node 133 and the body 601 of the power transistor 600. The PMOS transistor 515 may be turned on or off in response to the output signal of the NAND gate 525. The body of the PMOS transistor 515 may be connected to the output node 315.

Figure 6:
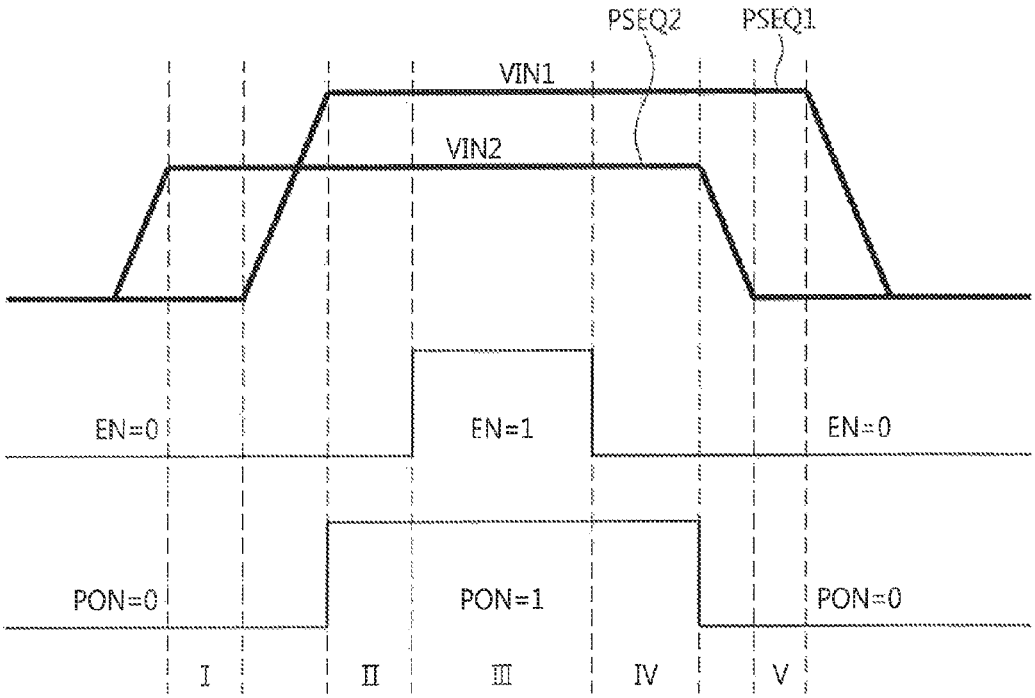
FIG. 6 is a timing chart of a first power sequence of a first voltage, a second power sequence of a second voltage, and control signals, according to an exemplary embodiment of the inventive concept.

FIG. 6 is a timing chart of a first power sequence PSEQ1 of the first voltage VIN1, a second power sequence PSEQ2 of the second voltage VIN2, and control signals, according to an exemplary embodiment of the inventive concept. Referring to FIG. 6, the second voltage VIN2 is powered up and powered down prior to the first voltage VIN1. Herein, "power-up" may mean ramping-up or increase and "power-down" may mean ramping-down or decrease. The first power sequence PSEQ1 of the first voltage VIN1 and the second power sequence PSEQ2 of the second voltage VIN2 are as shown in FIG. 6. The control signals include the operation control signal EN and the power-on signal PON.

Figure 7:
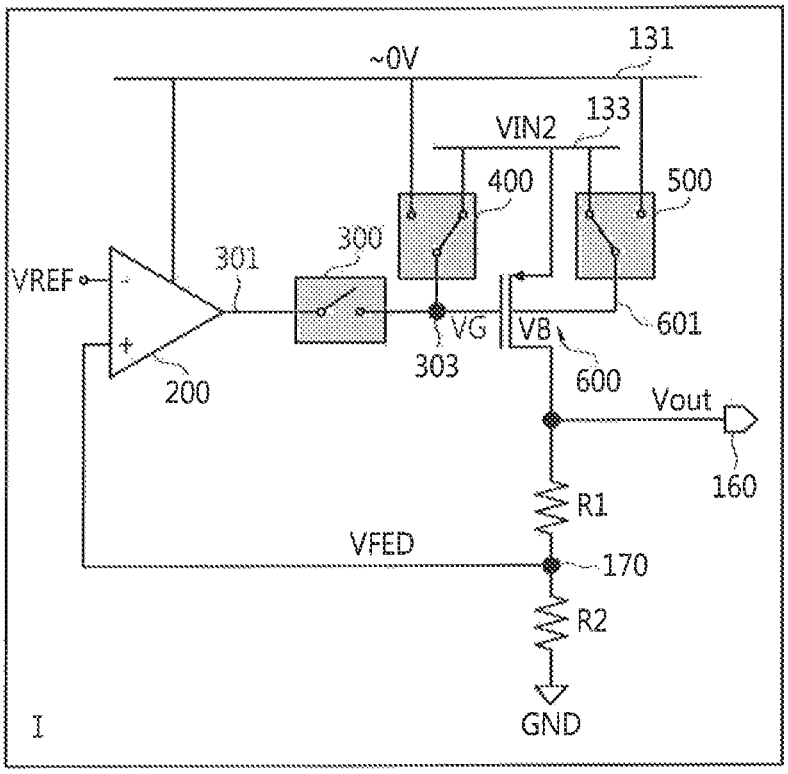
FIG. 7 is a diagram for explaining the operation of a voltage regulator, according to an exemplary embodiment of the inventive concept, which operates according to the first power sequence, the second power sequence, and the control signals illustrated in FIG. 6.

FIG. 7 is a diagram for explaining the operation of a voltage regulator, according to an exemplary embodiment of the inventive concept, which operates according to the first power sequence PSEQ1, the second power sequence PSEQ2, and the control signals EN and PON illustrated in FIG. 6. The operations of the switch circuit 150 and the switch circuits 300, 400, and 500 in a first period I of FIG. 6 will be described in detail with reference to FIGS. 1 through 7.

When the operation control signal EN is at the low level in the first period I, the power selector circuit 310A of the first switch circuit 300 outputs the second voltage VIN2, e.g., a higher one of the first voltage VIN1 and the second voltage VIN2 as the output voltage VBDS. When the power-on signal PON is at the low level (e.g., PON=0) as shown in FIG. 6, the NMOS transistor 325 illustrated in FIG. 2 is turned off in response to the power-on signal PON at the low level and the PMOS transistor 330 is turned off in response to the output signal of the inverter 320 which is at the high level.

The power selector circuit 310B of the second switch circuit 400 illustrated in FIG. 4 outputs the second voltage VIN2, e.g., a higher one of the first voltage VIN1 and the second voltage VIN2 as the output voltage VBDS. When both of the operation control signal EN and the power-on signal PON are at the low level, in other words, when the inverted operation control signal/EN is at the high level and the power-on signal PON is at the low level, the output signal of the inverter 420 and the output signal of the AND gate 425 are at a low level and the output signal of the NAND gate 430 is at a high level.

Accordingly, the PMOS transistor 410 is turned on in response to the output signal of the AND gate 425 at the low level. As a result, the second node 133 is connected with the gate 303 of the power transistor 600. The PMOS transistor 415 is turned off in response to the output signal of the NAND gate 430 at the high level. The second switch circuit 400 supplies the second voltage VIN2 to the gate 303 of the power transistor 600.

The power selector circuit 310C of the third switch circuit 500 illustrated in FIG. 5 outputs the second voltage VIN2, e.g., a higher one of the first voltage VIN1 and the second voltage VIN2 as the output voltage VBDS. When both of the operation control signal EN and the power-on signal PON are at the low level, in other words, when the inverted operation control signal/EN is at the high level and the power-on signal PON is at the low level; the output signal of the first inverter 520 is at a low level, the output signal of the NAND gate 525 is at a high level, and the output signal of the second inverter 530 is at a low level.

Accordingly, the PMOS transistor 510 is turned on in response to the output signal of the second inverter 530 at the low level. As a result, the second node 133 is connected with the body 601 of the power transistor 600. The PMOS transistor 515 is turned off in response to the output signal of the NAND gate 525 at the high level. The third switch circuit 500 supplies the second voltage VIN2 to the body 601 of the power transistor 600. The first voltage VIN1 may be approximately 0V in the first period I.

Figure 8:
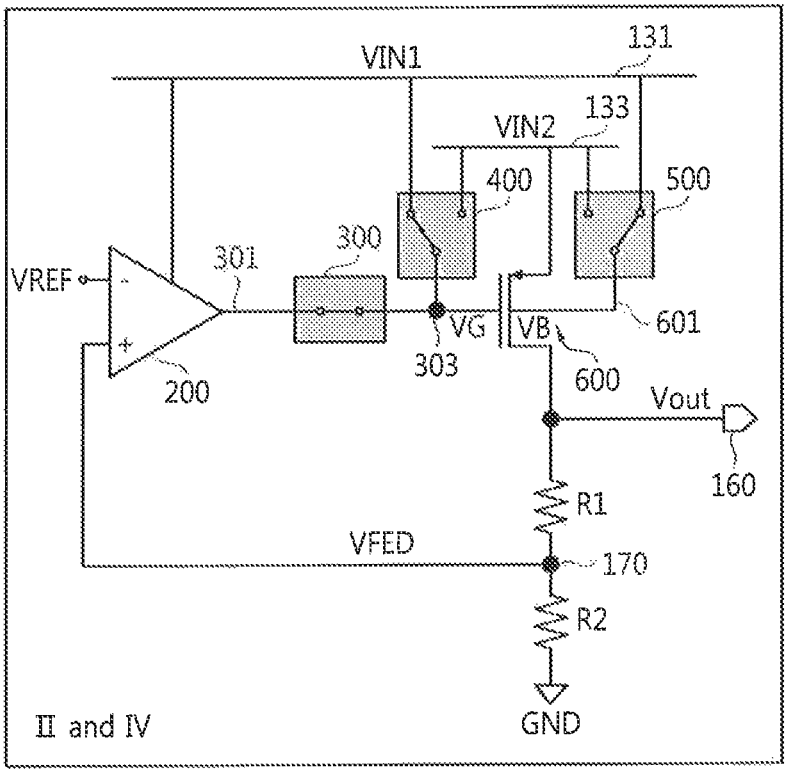
FIG. 8 is a diagram for explaining the operation of a voltage regulator, according to an exemplary embodiment of the inventive concept, which operates according to the first power sequence, the second power sequence, and the control signals illustrated in FIG. 6.

FIG. 8 is a diagram for explaining the operation of a voltage regulator, according to an exemplary embodiment of the inventive concept, which operates according to the first power sequence PSEQ1, the second power sequence PSEQ2, and the control signals EN and PON illustrated in FIG. 6. The operations of the switch circuits 300, 400, and 500 in a second period II or a fourth period IV of FIG. 6 will be described in detail with reference to FIGS. 1 through 6 and FIG. 8. The second period II and the fourth period IV may be the period of the sleep mode. In the second period II or the fourth period IV, the operation control signal EN is at the low level (e.g., EN=0), the power-on signal PON is at the high level (e.g., PON=1), and the inverted operation control signal/EN is at the high level.

In the second period II or the fourth period IV, the power selector circuit 310A of the first switch circuit 300 illustrated in FIG. 2 outputs the first voltage VIN1, e.g., a higher one of the first voltage VIN1 and the second voltage VIN2 as the output voltage VBDS.

When the power-on signal PON is at the high level (e.g., PON=1) as shown in FIG. 6, the NMOS transistor 325 is turned on in response to the power-on signal PON at the high level and the PMOS transistor 330 is turned on in response to the output signal of the inverter 320 at the low level. Accordingly, the output node 301 of the error amplifier 200 is electrically connected with the gate 303 of the power transistor 600.

The power selector circuit 310B of the second switch circuit 400 illustrated in FIG. 4 outputs the first voltage VIN1, e.g., a higher one of the first voltage VIN1 and the second voltage VIN2 as the output voltage VBDS. When the inverted operation control signal/EN is at the high level and the power-on signal PON is at the high level, the output signal of the inverter 420 and the output signal of the AND gate 425 are at the low level and the output signal of the NAND gate 430 is at the high level.

Accordingly, the PMOS transistor 410 is turned on in response to the output signal of the AND gate 425 at the low level. As a result, the first node 131 is connected with the gate 303 of the power transistor 600. The PMOS transistor 415 is turned off in response to the output signal of the NAND gate 430 at the high level. The second switch circuit 400 supplies the first voltage VIN1 to the gate 303 of the power transistor 600.

The power selector circuit 310C of the third switch circuit 500 illustrated in FIG. 5 outputs the first voltage VIN1, e.g., a higher one of the first voltage VIN1 and the second voltage VIN2 as the output voltage VBDS. When the inverted operation control signal/EN is at the high level and the power-on signal PON is at the high level; the output signal of the first inverter 520 is at the low level, the output signal of the NAND gate 525 is at the high level, and the output signal of the second inverter 530 is at the low level.

Accordingly, the PMOS transistor 510 is turned on in response to the output signal of the second inverter 530 at the low level. As a result, the first node 131 is connected with the body 601 of the power transistor 600. The PMOS transistor 515 is turned off in response to the output signal of the NAND gate 525 at the high level. The third switch circuit 500 supplies the first voltage VIN1 to the body 601 of the power transistor 600.

Although the first voltage VIN1 is supplied to the gate 303 and the body 601 of the power transistor 600 in the embodiment illustrated in FIG. 8, the second voltage VIN2 may be supplied to the gate 303 and the body 601 of the power transistor 600 according to an exemplary embodiment of the inventive concept. For this case, the internal structure of each of the second and third switch circuits 400 and 500 may be changed to supply the second voltage VIN2.

Figure 9:
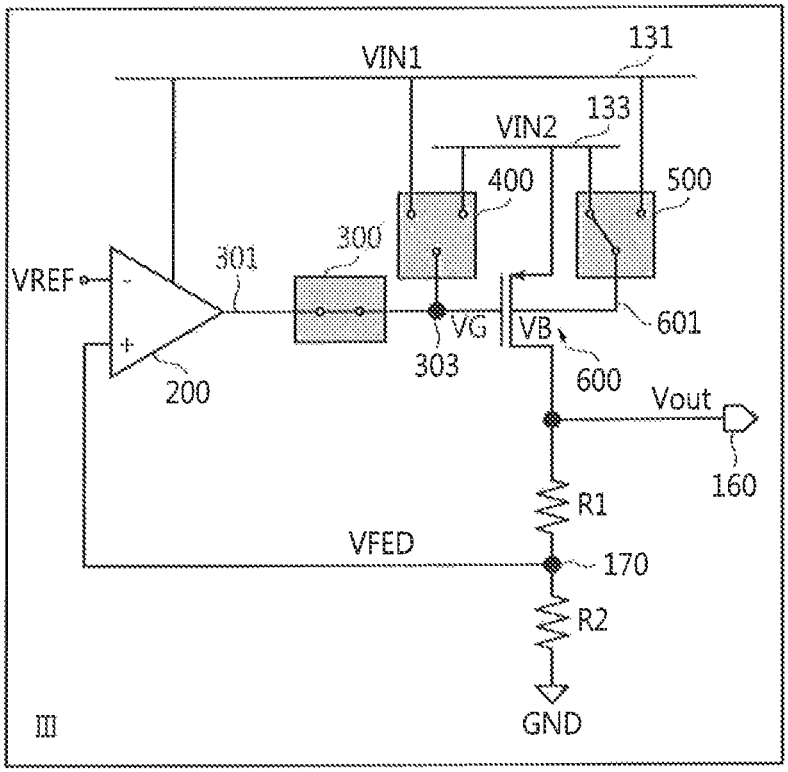
FIG. 9 is a diagram for explaining the operation of a voltage regulator, according to an exemplary embodiment of the inventive concept, which operates according to the first power sequence, the second power sequence, and the control signals illustrated in FIG. 6.

FIG. 9 is a diagram for explaining the operation of a voltage regulator, according to an exemplary embodiment of the inventive concept, which operates according to the first power sequence PSEQ1, the second power sequence PSEQ2, and the control signals EN and PON illustrated in FIG. 6. The operations of the switch circuits 300, 400, and 500 in a third period III of FIG. 6 will be described in detail with reference to FIGS. 1 through 6 and FIG. 9. The third period III may be the period of the active mode. In the third period III, the operation control signal EN is at the high level (e.g., EN=1), the power-on signal PON is at the high level (e.g., PON=1), and the inverted operation control signal/EN is at the low level.

In the third period III, the power selector circuit 310A of the first switch circuit 300 illustrated in FIG. 2 outputs the first voltage VIN1, e.g., a higher one of the first voltage VIN1 and the second voltage VIN2 as the output voltage VBDS. When the power-on signal PON is at the high level (e.g., PON=1) as shown in FIG. 6, the NMOS transistor 325 is turned on in response to the power-on signal PON at the high level and the PMOS transistor 330 is turned on in response to the output signal of the inverter 320 at the low level. Accordingly, the output node 301 of the error amplifier 200 is electrically connected with the gate 303 of the power transistor 600.

The power selector circuit 310B of the second switch circuit 400 illustrated in FIG. 4 outputs the first voltage VIN1, e.g., a higher one of the first voltage VIN1 and the second voltage VIN2 as the output voltage VBDS. When the inverted operation control signal/EN is at the low level and the power-on signal PON is at the high level; the output signal of the inverter 420, the output signal of the AND gate 425, and the output signal of the NAND gate 430 are all at the high level.

Accordingly, the PMOS transistor 410 is turned off in response to the output signal of the AND gate 425 at the high level and the PMOS transistor 415 is turned off in response to the output signal of the NAND gate 430 at the high level. As a result, the second switch circuit 400 does not supply either the first voltage VIN1 or the second voltage VIN2 to the gate 303 of the power transistor 600. In other words, the second switch circuit 400 is turned off.

The power selector circuit 310C of the third switch circuit 500 illustrated in FIG. 5 outputs the first voltage VIN1, e.g., a higher one of the first voltage VIN1 and the second voltage VIN2 as the output voltage VBDS. When the inverted operation control signal/EN is at the low level and the power-on signal PON is at the low level; the output signal of the first inverter 520 is at the high level, the output signal of the NAND gate 525 is at the low level, and the output signal of the second inverter 530 is at the high level.

Accordingly, the PMOS transistor 510 is turned off in response to the output signal of the second inverter 530 at the high level and the PMOS transistor 515 is turned on in response to the output signal of the NAND gate 525 at the low level. The third switch circuit 500 supplies the second voltage VIN2 to the body 601 of the power transistor 600. In other words, the second node 133 is electrically connected with the body 601 of the power transistor 600.

Figure 10:
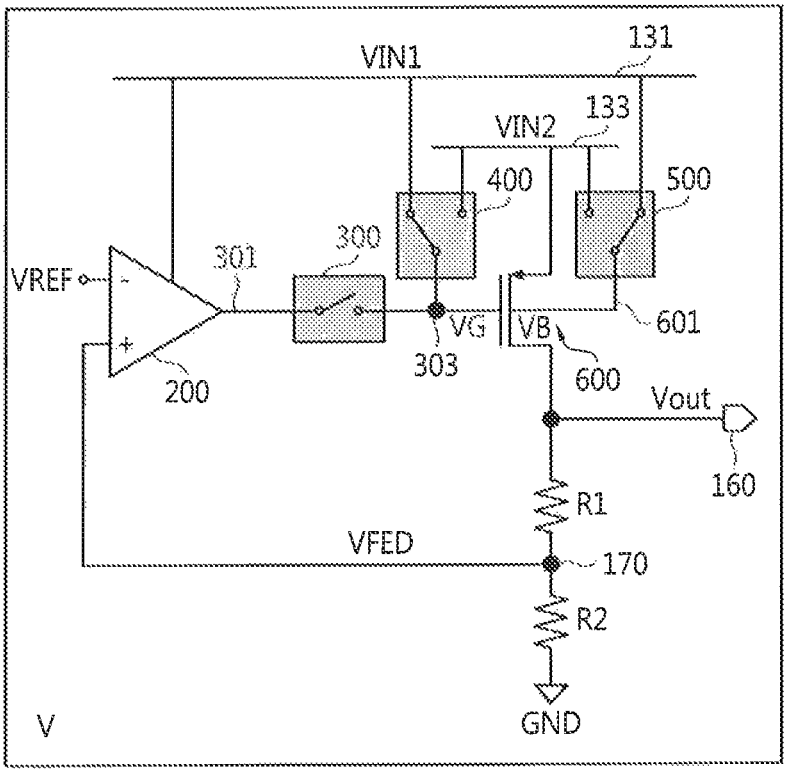
FIG. 10 is a diagram for explaining the operation of a voltage regulator, according to an exemplary embodiment of the inventive concept, which operates according to the first power sequence, the second power sequence, and the control signals illustrated in FIG. 6.

FIG. 10 is a diagram for explaining the operation of a voltage regulator, according to an exemplary embodiment of the inventive concept, which operates according to the first power sequence PSEQ1, the second power sequence PSEQ2, and the control signals EN and PON illustrated in FIG. 6. The operations of the switch circuits 300, 400, and 500 in a fifth period V of FIG. 6 will be described in detail with reference to FIGS. 1 through 6 and FIG. 10. In the fifth period V, the operation control signal EN is at the low level (e.g., EN=0), the power-on signal PON is at the low level (e.g., PON=0), and the inverted operation control signal/EN is at the high level.

In the fifth period V, the power selector circuit 310A of the first switch circuit 300 illustrated in FIG. 2 outputs the first voltage VIN1, e.g., a higher one of the first voltage VIN1 and the second voltage VIN2 as the output voltage VBDS. When the power-on signal PON is at the low level (e.g., PON=0) as shown in FIG. 6, the NMOS transistor 325 is turned off in response to the power-on signal PON at the low level and the PMOS transistor 330 is turned off in response to the output signal of the inverter 320 at the high level. Accordingly, the output node 301 of the error amplifier 200 is disconnected from the gate 303 of the power transistor 600.

The power selector circuit 310B of the second switch circuit 400 illustrated in FIG. 4 outputs the first voltage VIN1, e.g., a higher one of the first voltage VIN1 and the second voltage VIN2 as the output voltage VBDS. When the inverted operation control signal/EN is at the high level and the power-on signal PON is at the low level, the output signal of the inverter 420 and the output signal of the AND gate 425 are at the low level and the output signal of the NAND gate 430 is at the high level.

Accordingly, the PMOS transistor 410 is turned on in response to the output signal of the AND gate 425 at the low level and the PMOS transistor 415 is turned off in response to the output signal of the NAND gate 430 at the high level. The first voltage VIN1 is supplied to the gate 303 of the power transistor 600 through the PMOS transistor 410. In other words, the first node 131 is electrically connected with the gate 303 of the power transistor 600.

The power selector circuit 310C of the third switch circuit 500 illustrated in FIG. 5 outputs the first voltage VIN1, e.g., a higher one of the first voltage VIN1 and the second voltage VIN2 as the output voltage VBDS. When the inverted operation control signal/EN is at the high level and the power-on signal PON is at the high level; the output signal of the first inverter 520 is at the low level, the output signal of the NAND gate 525 is at the high level, and the output signal of the second inverter 530 is at the low level.

Accordingly, the PMOS transistor 510 is turned on in response to the output signal of the second inverter 530 at the low level and the PMOS transistor 515 is turned off in response to the output signal of the NAND gate 525 at the high level. The first voltage VIN1 is supplied to the body 601 of the power transistor 600 through the PMOS transistor 510. In other words, the first node 131 is electrically connected with the body 601 of the power transistor 600.

Figure 11:
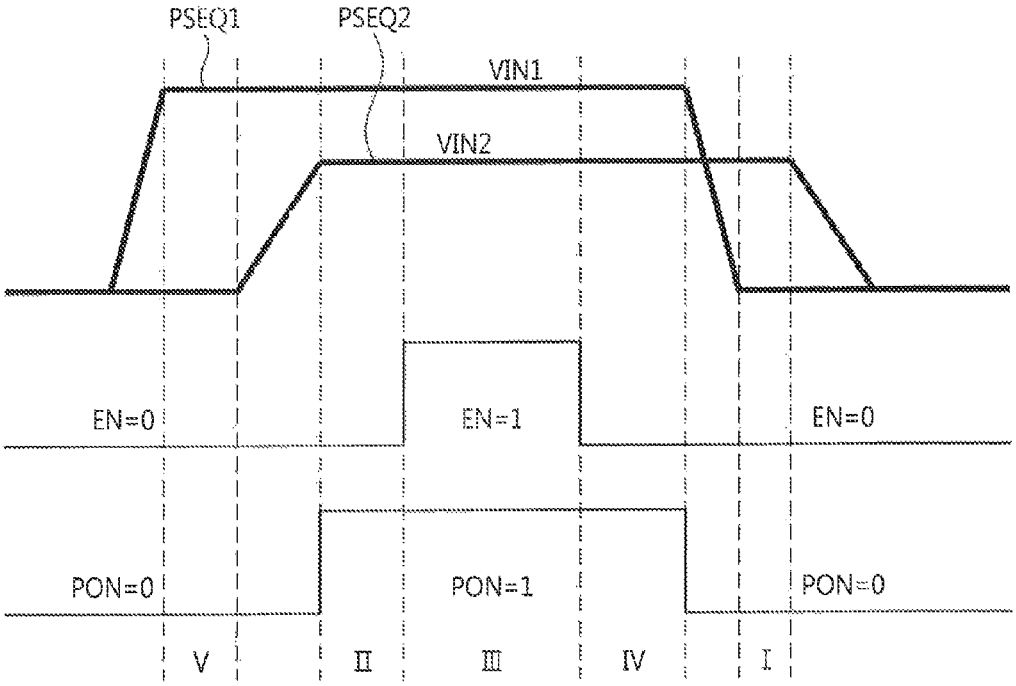
FIG. 11 is a diagram for explaining the operation of a voltage regulator, according to an exemplary embodiment of the inventive concept, which operates according to the first power sequence, the second power sequence, and the control signals illustrated in FIG. 6.

FIG. 11 is a diagram for explaining the operation of a voltage regulator, according to an exemplary embodiment of the inventive concept, which operates according to the first power sequence PSEQ1, the second power sequence PSEQ2, and the control signals EN and PON illustrated in FIG. 6. Referring to FIG. 11, the first voltage VIN1 is powered up and powered down prior to the second voltage VIN2. The periods I through V illustrated in FIG. 11 respectively correspond to the periods I through V illustrated in FIG. 6. Accordingly, the operations of the switch circuits 300, 400, and 500 in the periods I through V illustrated in FIG. 11 are the same as those of the switch circuits 300, 400, and 500 in the periods I through V illustrated in FIG. 6.

For example, in the fifth period V, the operation control signal EN is at the low level (e.g., EN=0), the power-on signal PON is at the low level (e.g., PON=0), and the inverted operation control signal/EN is at the high level. The power selector circuit 310A of the first switch circuit 300 illustrated in FIG. 2 outputs the first voltage VIN1 as the output voltage VBDS. The NMOS transistor 325 and the PMOS transistor 330 are turned off, and therefore, the output node 301 of the error amplifier 200 is not connected with the gate 303 of the power transistor 600.

The power selector circuit 310B of the second switch circuit 400 illustrated in FIG. 4 outputs the first voltage VIN1 as the output voltage VBDS. The output signal of the inverter 420 and the output signal of the AND gate 425 are at the low level and the output signal of the NAND gate 430 is at the high level. Accordingly, the PMOS transistor 410 is turned on and the PMOS transistor 415 is turned off. As a result, the first voltage VIN1 is supplied to the gate 303 of the power transistor 600 through the PMOS transistor 410.

The power selector circuit 310C of the third switch circuit 500 illustrated in FIG. 5 outputs the first voltage VIN1 as the output voltage VBDS. The output signal of the first inverter 520 is at the low level, the output signal of the NAND gate 525 is at the high level, and the output signal of the second inverter 530 is at the low level. Accordingly, the PMOS transistor 510 is turned on and the PMOS transistor 515 is turned off. As a result, the first voltage VIN1 is supplied to the body 601 of the power transistor 600 through the PMOS transistor 510.

Figure 12:
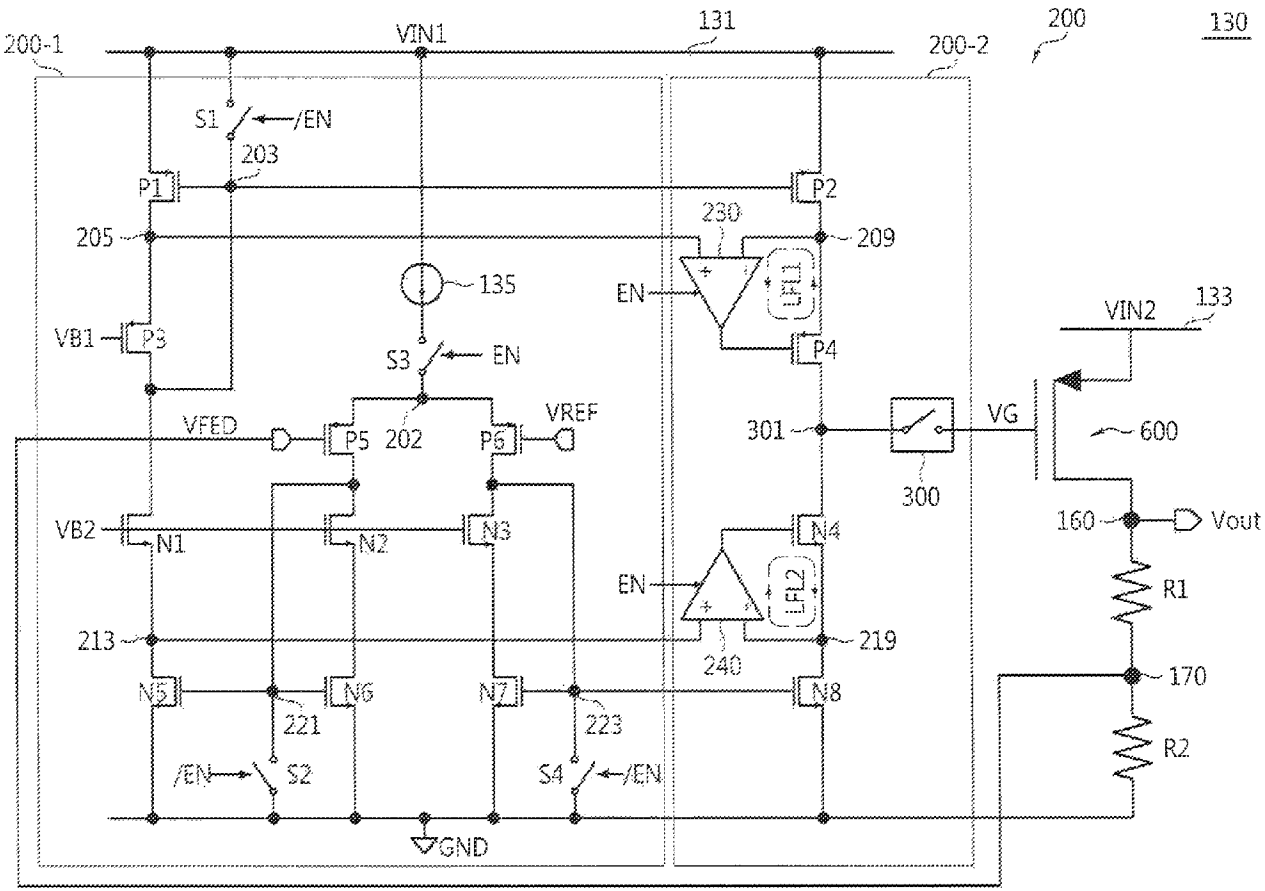
FIG. 12 is a circuit diagram of an error amplifier illustrated in FIG. 1 according to an exemplary embodiment of the inventive concept.

FIG. 12 is a circuit diagram of the error amplifier 200 illustrated in FIG. 1 according to an exemplary embodiment of the inventive concept. Referring to FIGS. 1 and 12, the error amplifier 200 may include an amplifier stage 200-1 and an output stage 200-2. For clarity of the description, the first switch circuit 300, the power transistor 600, and the resistors R1 and R2 are illustrated together with the error amplifier 200 in FIG. 12.

It is assumed that switches S1 through S4 are turned on in response to the operation control signal EN at the high level and are turned off in response to the operation control signal EN at the low level and local amplifiers 230 and 240 are enabled in response to the operation control signal EN at the high level. Accordingly, when the operation control signal EN is at the high level, the switch S3 is turned on and the switches S1, S2, and S4 are turned off. For example, the switches S1 through S4 may be transmission gates, but the inventive concept is not limited thereto.

For example, when the operation control signal EN is at the low level, the switches S1, S2, and S4 are turned on in response to the inverted operation control signal /EN at the high level. Accordingly, a gate of each of current source transistors P1 and P2 included in the error amplifier 200 is connected to the first node 131 supplying the first voltage VIN1, and therefore, the current source transistors P1 and P2 are turned off. As a result, a current path of the current source transistors P1 and P2 is completely cut off. In addition, since a gate of each of current source transistors N5, N6, N7, and N8 is connected to the ground GND, the current source transistors N5 through N8 are turned off. As a result, a current path of each of the current source transistors N5 through N8 is completely cut off.

The amplifier stage 200-1 may use the first voltage VIN1 as an operating voltage and may amplify the difference between the reference voltage VREF and the feedback voltage VFED. For example, the amplifier stage 200-1 may have a 2-stage cascode architecture. The bias voltage generator 800 illustrated in FIG. 1 may supply the bias voltages VB1 and VB2 to the amplifier stage 200-1.

The error amplifier 200 may include a plurality of PMOS transistors P1 through P6 and a plurality of NMOS transistors N1 through N8. The PMOS transistor P3 may operate in response to the first bias voltage VB1 and the NMOS transistors N1 through N3 may operate in response to the second bias voltage VB2. When the switch S3 is turned on, a constant current source 135 may supply bias current to a common node 202 connected to a pair of the amplification transistors P5 and P6.

The switch S1 is connected between the first node 131 and a node 203; the PMOS transistor P1 is connected between the first node 131 and a node 205; and a gate of the PMOS transistor P1 is connected to the node 203. The bias PMOS transistor P3 is connected between the nodes 203 and 205; the bias NMOS transistor N1 is connected between the node 203 and a node 213; the NMOS transistor N5 is connected between the node 213 and the ground GND; a gate of the NMOS transistor N5 is connected to a node 221; the switch S2 is connected between the node 221 and the ground GND; NMOS transistors N2 and N6 are connected in series between the node 221 and the ground GND; and a gate of the NMOS transistor N6 is connected to the node 221.

The PMOS transistor P5 operates in response to the feedback voltage VFED and is connected between the nodes 202 and 221; the PMOS transistor P6 operates in response to the reference voltage VREF and is connected between the node 202 and a node 223; NMOS transistors N3 and N7 are connected in series between the node 223 and the ground GND; a gate of the NMOS transistor N7 is connected to the node 223; and the switch S4 is connected between the node 223 and the ground GND. The PMOS transistors P5 and P6 may amplify the difference between the reference voltage VREF and the feedback voltage VFED.

The output stage 200-2 may output a signal amplified by the amplifier stage 200-1 to the first switch circuit 300 through the output node 301 of the error amplifier 200. Due to the 2-stage cascode architecture, the swing range of the gate voltage VG of the gate 303 of the power transistor 600 may increase.

The output stage 200-2 may have the 2-stage cascode architecture including local feedback loops LFL1 and LFL2. The PMOS transistor P2 is connected between the first node 131 and a node 209 and a gate of the PMOS transistor P2 is connected to the node 203.

The first local amplifier 230 may amplify a difference between a voltage of the node 205 and a voltage of the node 209 and may apply an amplified signal to a gate of the PMOS transistor P4. The first local amplifier 230 may be located on a pull-up path between the first node 131 and the output node 301 of the error amplifier 200. The PMOS transistor P4 is connected between the node 209 and the output node 301 of the error amplifier 200.

The NMOS transistor N4 may be connected between the output node 301 of the error amplifier 200 and a node 219. The second local amplifier 240 may amplify a difference between a voltage of the node 213 and a voltage of the node 219 and may apply an amplified signal to a gate of the NMOS transistor N4. The second local amplifier 240 may be located on a pull-down path between the output node 301 of the error amplifier 200 and the ground GND. The NMOS transistor N8 is connected between the node 219 and the ground GND and a gate of the NMOS transistor N8 is connected to the node 223.

Since the output stage 200-2 has the 2-stage cascode architecture including two local feedback loops LFL1 and LFL2, the loop gain or the overall gain of the error amplifier 200 may increase. For example, the loop gain of the output stage 200-2 may increase to be about 10,000 times higher (e.g., 80 dB) than the loop gain of a conventional error amplifier. For example, loop gain may be the sum of the gain around a feedback loop and may be expressed in decibels.

When the output stage 200-2 has the 2-stage cascode architecture without including two local feedback loops LFL1 and LFL2, the loop gain of the output stage 200-2 may increase to be about 100 times higher (e.g., 40 dB) than the loop gain of a conventional error amplifier.

Figure 13:
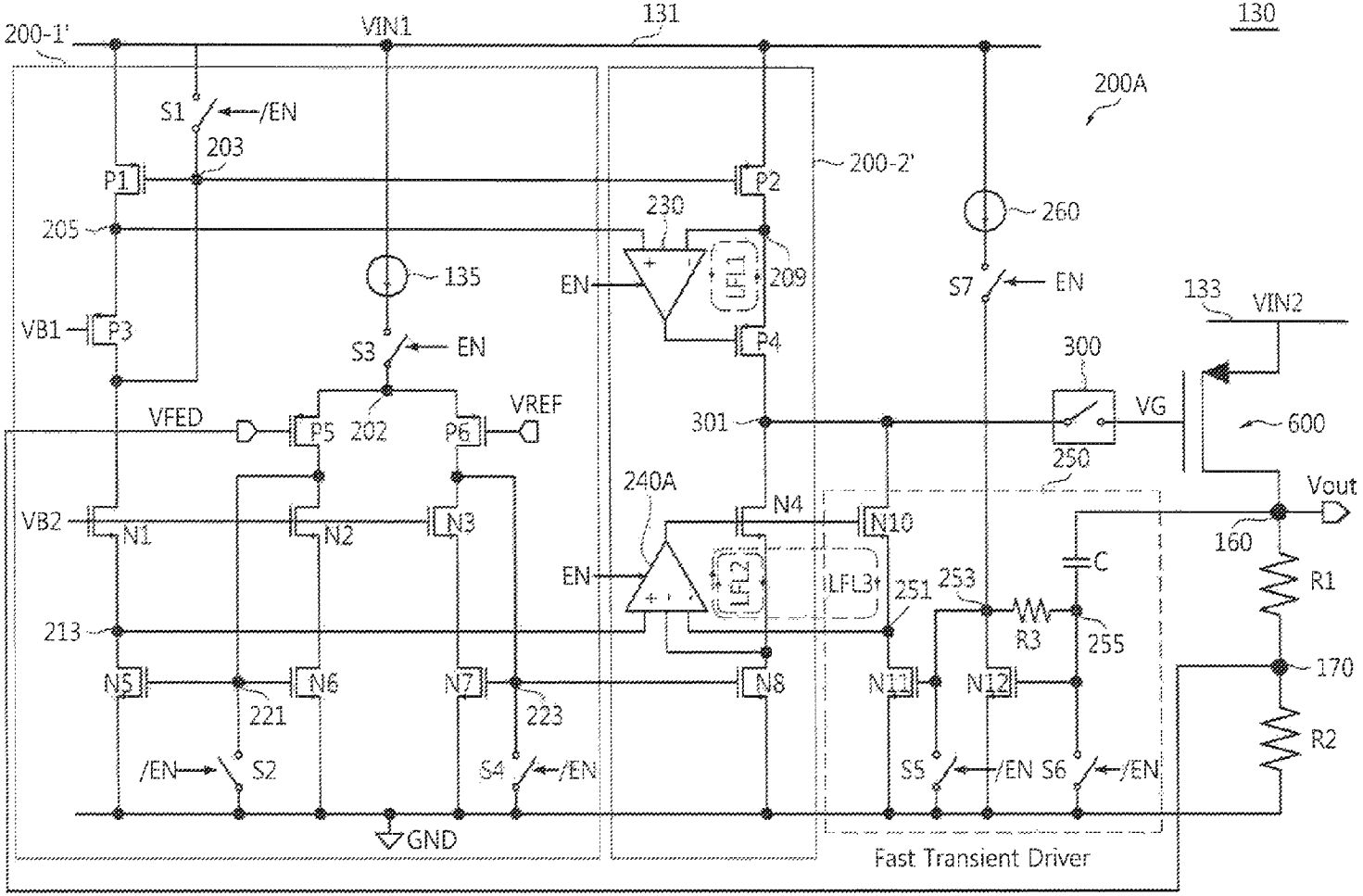
FIG. 13 is a circuit diagram of an error amplifier illustrated in FIG. 1 according to an exemplary embodiment of the inventive concept.

FIG. 13 is a circuit diagram of an error amplifier 200A according to an exemplary embodiment of the inventive concept. Referring to FIGS. 12 and 13, it is assumed that switches S1 through S7 are turned on in response to the operation control signal EN at the high level and are turned off in response to the operation control signal EN at the low level and local amplifiers 230 and 240A are enabled in response to the operation control signal EN at the high level. Accordingly, when the operation control signal EN is at the high level, the switches S3 and S7 are turned on and the switches S1, S2, S4, S5, and S6 are turned off. The switches S1 through S7 may be transmission gates, but the inventive concept is not limited thereto.

For example, when the operation control signal EN is at the low level, the switches S1, S2, S4, S5, and S6 are turned on in response to the inverted operation control signal/EN at the high level. Accordingly, a gate of each of the current source transistors P1 and P2 included in the error amplifier 200A is connected to the first node 131 supplying the first voltage VIN1, and therefore, the current source transistors P1 and P2 are turned off. As a result, a current path of the current source transistors P1 and P2 is completely cut off. In addition, since a gate of each of current source transistors N5, N6, N7, N8, N11, and N12 is connected to the ground GND, the current source transistors N5 through N8, N11, and N12 are turned off. As a result, a current path of each of the current source transistors N5 through N8, N11, and N12 is completely cut off.

The error amplifier 200A may include an amplifier stage 200-1', an output stage 200-2', and a fast transient driver (FTD) 250. The structure and operations of the amplifier stage 200-1' are the same as those of the amplifier stage 200-1 of FIG. 12. The structure and operations of the output stage 200-2' are the same as those of the output stage 200-2 of FIG. 12 with the exception that the two-input local amplifier 240 is replaced with a three-input local amplifier 240A.

Referring to FIGS. 1 and 13, a transient characteristic of the gate voltage VG of the power transistor 600 which occurs due to fast change in a load current Iload supplied to the loading block 180 through the output node 160 of the voltage regulator 130 may become deteriorated. However, the FTD 250 may keep the transient characteristic of the gate voltage VG from deteriorating much. For example, the FTD 250 may perform gain boosting.

The FTD 250 may include MOS transistors N10 and N11 connected in series between the output node 301 of the error amplifier 200A and the ground GND, a resistor R3 connected between nodes 253 and 255, a capacitor C connected between the output node 160 and the node 255, a constant current source 260 and the switch S7 connected in series between the first node 131 and the node 253, and the MOS transistor N12 connected between the node 253 and the ground GND.

The NMOS transistor N10 is connected between the output node 301 and a node 251; a gate of the NMOS transistor N10 is connected to an output terminal of the second local amplifier 240A. A gate of the NMOS transistor N11 is connected to the node 253; and a gate of the NMOS transistor N12 is connected to the node 255. The switch S5 is connected between the node 253 and the ground GND; the switch S6 is connected between the node 255 and the ground GND.

As described above, when the FTD 250 is included within the error amplifier 200A, the two-input second local amplifier 240 illustrated in FIG. 12 may be replaced with the three-input local amplifier 240A illustrated in FIG. 13. In other words, the structure and operations of the error amplifier 200 illustrated in FIG. 12 are the same as or similar to those of the error amplifier 200A illustrated in FIG. 13 except for the three-input local amplifier 240A, the FTD 250, the constant current source 260, and the switch S7.

As shown in FIG. 13, the three-input local amplifier 240A and the NMOS transistor N4 form the second local feedback loop LFL2. The three-input local amplifier 240A and the NMOS transistor N10 form the third local feedback loop LFL3.

In other words, two local feedback loops LFL2 and LFL3 can be formed using the three-input local amplifier 240A and the NMOS transistors N4 and N10. The three-input local amplifier 240A forming each of the local feedback loops LFL2 and LFL3 may increase an output impedance of the FTD 250. Accordingly, the gain of the error amplifier 200A increases. In other words, since the local feedback loops LFL1 and LFL2 are included in the error amplifier 200, an output impedance and a loop gain increase. In addition, since the local feedback loops LFL1, LFL2, and LFL3 are included in the error amplifier 200A, an output impedance and a loop gain increase.

As described above with reference to FIGS. 12 and 13, when the dropout voltage of the voltage regulator 130 decreases, the gain of the error amplifier 200 including the output stage 200-2 illustrated in FIG. 12 or the output stage 200-2' and the FTD 250 illustrated in FIG. 13 may increase even though the gain of the power transistor 600 decreases. As a result, the overall gain of the voltage regulator 130 increases.

In the voltage regulator 130, an abnormal operation of the voltage regulator 130 caused by the decrease of an input voltage of the voltage regulator 130 is corrected using multi-power, e.g., the first and second voltages VIN1 and VIN2 and a decrease of the loop gain of the voltage regulator 130, which is caused by a decrease of a dropout voltage, is also corrected at the same time by using gain boosting.

Figure 14:
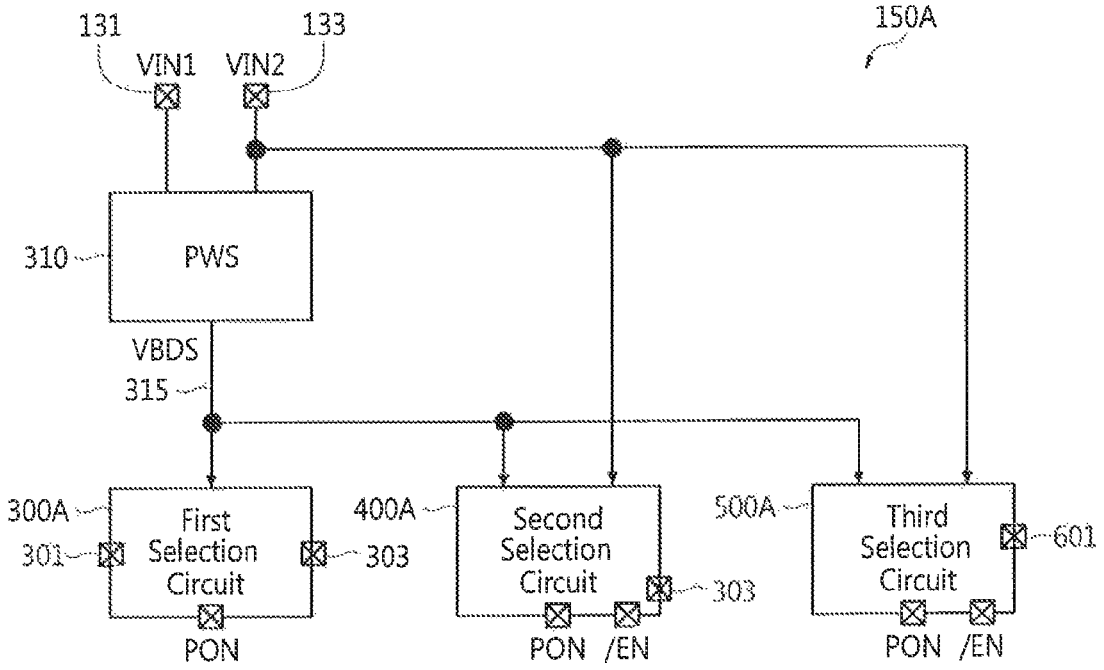
FIG. 14 is a block diagram of a switch circuit illustrated in FIG. 1 according to an exemplary embodiment of the inventive concept.

FIG. 14 is a block diagram of the switch circuit 150 illustrated in FIG. 1 according to an exemplary embodiment of the inventive concept. In particular, FIG. 14 shows an example 150A of the switch circuit 150 of FIG. 1. Referring to FIGS. 2 through 5 and FIG. 14, the switch circuits 300, 400, and 500 include the power selector circuits 310A, 310B, and 310C, respectively. However, selection circuits 300A, 400A, and 500A included in the switch circuit 150A illustrated in FIG. 14 may share a single power selector circuit 310 with one another. In other words, the first selection circuit 300A operates using the output voltage VBDS of the power selector circuit 310 and the second and third selection circuits 400A and 500A operate using the output voltage VBDS of the power selector circuit 310 and the second voltage VIN2.

Figure 15:
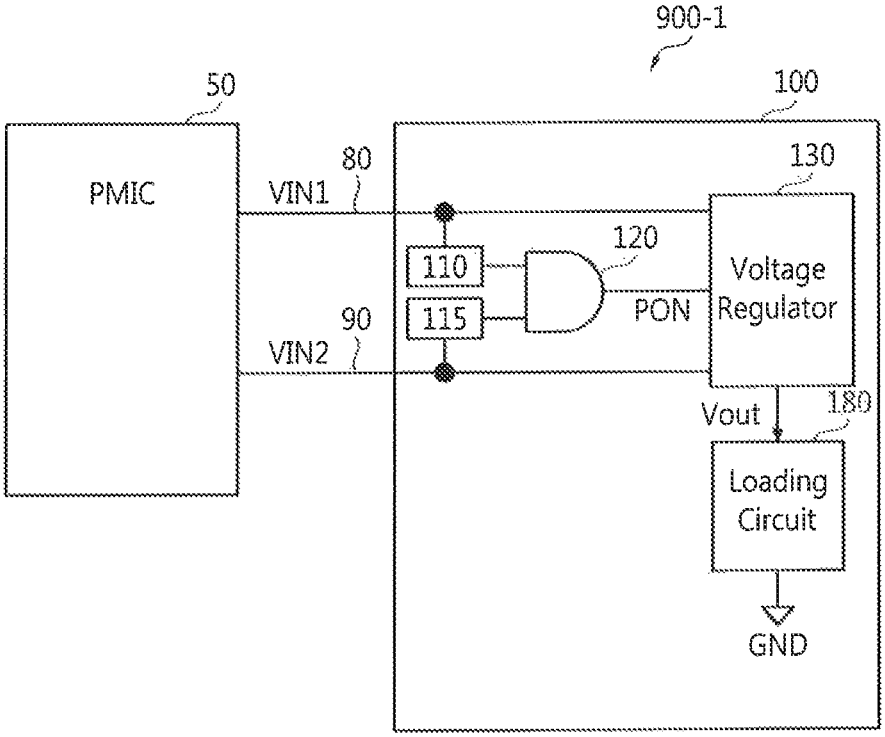
FIG. 15 is a block diagram of an electronic device including the IC illustrated in FIG. 1 and a power management IC according to an exemplary embodiment of the inventive concept.

FIG. 15 is a block diagram of an electronic device 900-1 including the IC 100 illustrated in FIG. 1 and a power management IC (PMIC) 50 according to an exemplary embodiment of the inventive concept. Referring to FIGS. 1 through 15, the electronic device 900-1 includes the PMIC 50 and the IC 100.

The PMIC 50 transmits the first voltage VIN1 to the IC 100 through a first transmission line 80 and transmits the second voltage VIN2 to the IC 100 through a second transmission line 90. Although the IC 100 is schematically illustrated in FIG. 15, the IC 100 illustrated in FIG. 15 refers to the IC 100 illustrated in FIG. 1.

Figure 16:
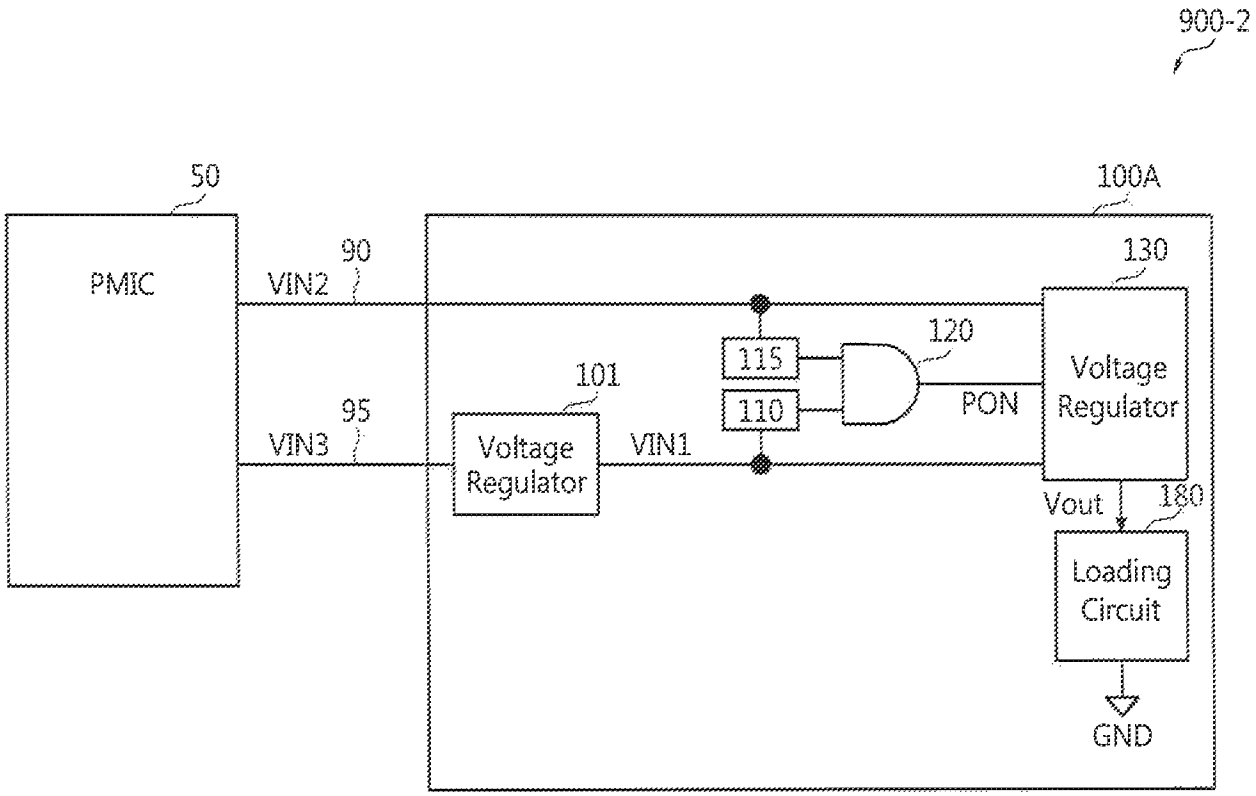
FIG. 16 is a block diagram of an electronic device including the IC illustrated in FIG. 1 and a power management IC according to an exemplary embodiment of the inventive concept.

FIG. 16 is a block diagram of an electronic device 900-2 according to an exemplary embodiment of the inventive concept. Referring to FIGS. 1 through 14 and FIG. 16, the electronic device 900-2 includes the PMIC 50 and an IC 100A. The PMIC 50 transmits the second voltage VIN2 to the IC 100A through the second transmission line 90 and transmits a third voltage VIN3 to the IC 100A through a third transmission line 95.

The structure of the IC 100A illustrated in FIG. 16 is the same as that of the IC 100 illustrated in FIG. 15 except for a voltage regulator 101. The voltage regulator 101 may generate the first voltage VIN1 from the third voltage VIN3. The second voltage VIN2 supplied from the PMIC 50 and the first voltage VIN1 generated by the voltage regulator 101 are supplied to the voltage regulator 130. The third voltage VIN3 may be higher than the first voltage VIN1. For instance, the third voltage VIN3 may be 3.3 V, the first voltage VIN1 may be 1.8 V, and the second voltage VIN2 may be 1.2 V, but the inventive concept is not limited thereto.

Figure 17:
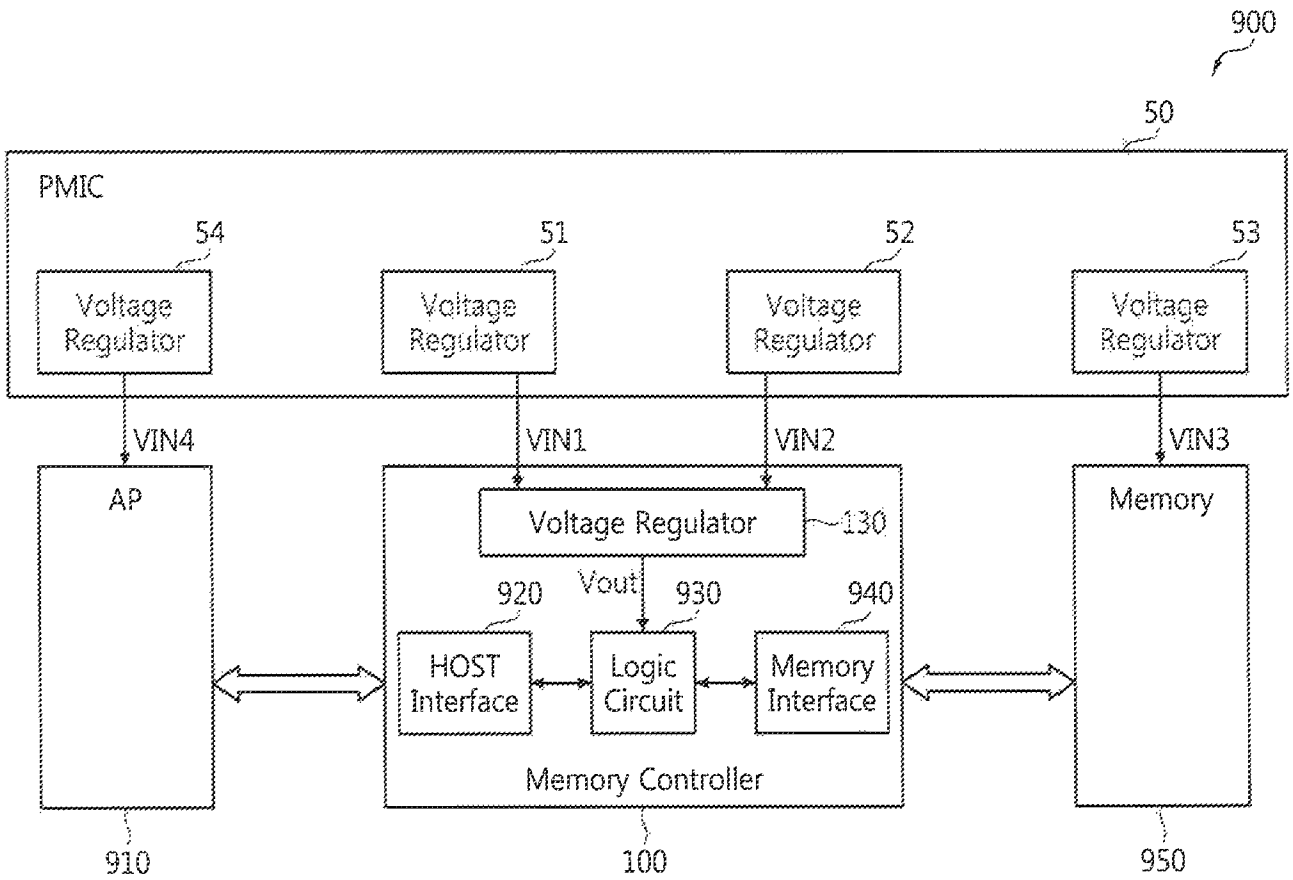
FIG. 17 is a block diagram of an electronic device including the IC illustrated in FIG. 1 and a power management IC according to an exemplary embodiment of the inventive concept.

FIG. 17 is a block diagram of an electronic device 900 including the IC 100 illustrated in FIG. 1 and the PMIC 50 according to an exemplary embodiment of the inventive concept. Referring to FIGS. 1 through 14 and FIG. 17, the electronic device 900 may include the PMIC 50, an application processor (AP) 910, a memory controller 100, and a memory 950. The electronic devices 900-1, 900-2, and 900 illustrated in FIGS. 15 through 17, respectively, may be mobile devices. Each of the mobile devices may be a laptop computer, a cellular phone, a smart phone, a tablet personal computer (PC), a personal digital assistant (PDA), an enterprise digital assistant (EDA), a digital still camera, a digital video camera, a portable multimedia player (PMP), a personal navigation device or portable navigation device (PND), a handheld game console, a mobile internet device (MID), a wearable computer, an internet of things (IoT) device, an internet of everything (IoE) device, a drone, or an e-book.

The PMIC 50 may include voltage regulators 51, 52, 53, and 54 which respectively generate voltages VIN1, VIN2, VIN3, and VIN4. Each of the voltage regulators 51, 52, 53, and 54 may be an LDO voltage regulator or a switching voltage regulator (e.g., a buck converter).

The first voltage regulator 51 generates the first voltage VIN1 supplied to the memory controller 100. The second voltage regulator 52 generates the second voltage VIN2 supplied to the memory controller 100. The third voltage regulator 53 generates the third voltage VIN3 supplied to the memory 950. The fourth voltage regulator 54 generates the fourth voltage VIN4 supplied to the AP 910.

The IC 100 described with reference to FIGS. 1 through 14 may refer to the memory controller 100, but the inventive concept is not limited thereto. The memory controller 100 using multi-power VIN1 and VIN2 may include the voltage regulator 130, a host interface 920, a logic circuit 930, and a memory interface 940. The memory controller 100 may also include the elements 110, 115, 120, and 125 illustrated in FIG. 1. The voltage regulator 130 may supply the output voltage Vout to the logic circuit 930. The logic circuit 930 may be the loading block 180 illustrated in FIG. 1 but is not limited thereto.

The host interface 920 may interface data between the AP 910 and the logic circuit 930. The memory interface 940 may interface data between the logic circuit 930 and the memory 950. The memory interface 940 may be a memory controller interface.

The AP 910 using the fourth voltage VIN4 may control the operation of the memory controller 100 and may communicate data with the memory controller 100. The memory controller 100 may control the operations, e.g., the write and read operations, of the memory 950 and may communicate data with the memory 950 according to the control of the AP 910.

The memory 950 using the third voltage VIN3 may include a volatile or a non-volatile memory. The volatile memory may be random access memory (RAM), dynamic RAM (DRAM), or static RAM (SRAM). The non-volatile memory may be an electrically erasable programmable read-only memory (EEPROM), a flash memory, magnetic RAM (MRAM), a spin-transfer torque MRAM, a ferroelectric RAM (FeRAM), a phase-change RAM (PRAM), or a resistive RAM (RRAM).

Figure 18:
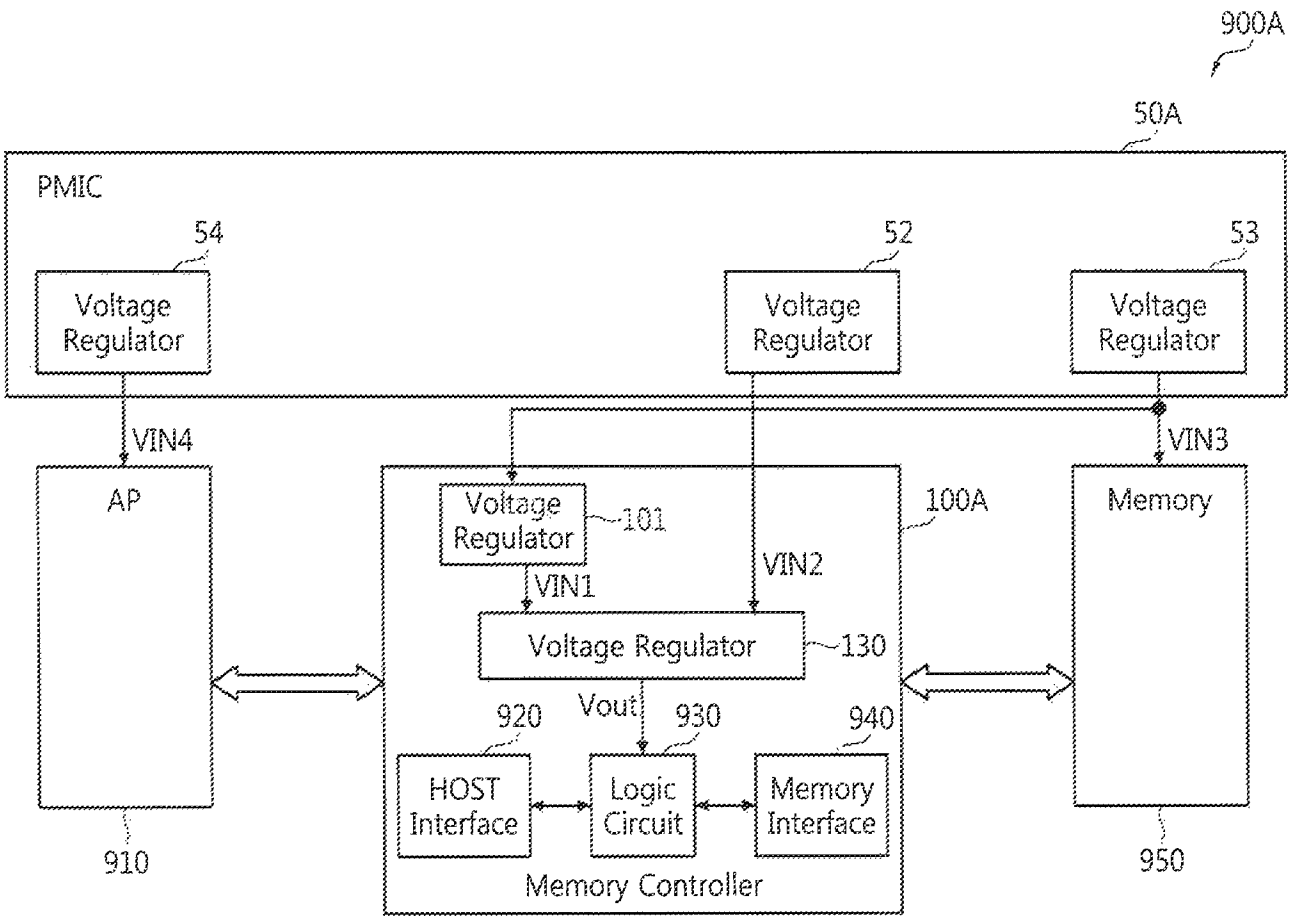
FIG. 18 is a block diagram of an electronic device including the IC illustrated in FIG. 1 and a power management IC according to an exemplary embodiment of the inventive concept.

FIG. 18 is a block diagram of an electronic device 900A according to an exemplary embodiment of the inventive concept. Referring to FIGS. 1 through 14 and FIG. 18, the electronic device 900A may include a PMIC 50A, the AP 910, a memory controller 100A, and the memory 950.

The PMIC 50A of FIG. 18 includes one less voltage regulator than the PMIC 50 of FIG. 17. The second voltage regulator 52 of the PMIC 50A generates the second voltage VIN2 supplied to the memory controller 100A. The third voltage regulator of the PMIC 50A 53 generates the third voltage VIN3 supplied to the memory controller 100A and the memory 950. The fourth voltage regulator 54 of the PMIC 50A generates the fourth voltage VIN4 supplied to the AP 910.

As described above with reference to FIG. 16, the voltage regulator 101 may generate the first voltage VIN1 from the third voltage VIN3. The memory controller 100A may also include the elements 110, 115, 120, and 125 illustrated in FIG. 1. The memory controller 100A is an example of the IC 100 described with reference to FIGS. 1 through 14 and may refer to the IC 100A described with reference to FIG. 16.

Figure 19:
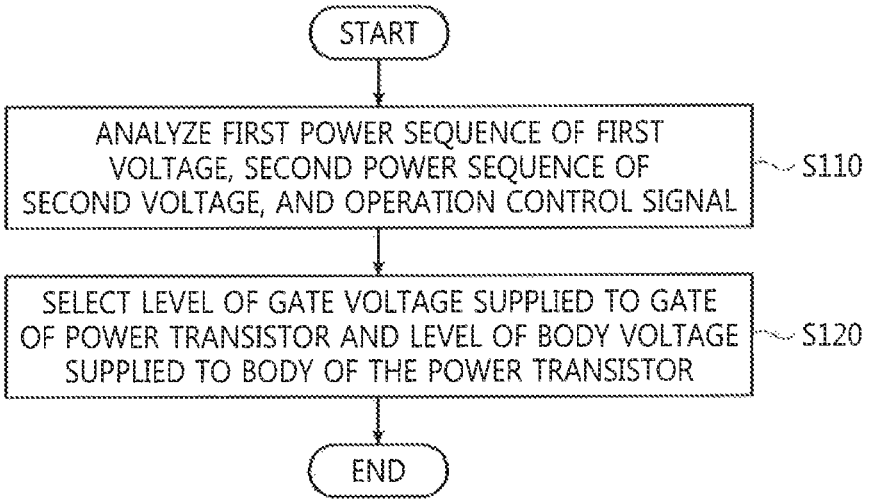
FIG. 19 is a flowchart of the operation of a voltage regulator according to an exemplary embodiment of the inventive concept.

FIG. 19 is a flowchart of the operation of the voltage regulator 130 according to an exemplary embodiment of the inventive concept. Referring to FIGS. 1 through 19, the voltage regulator 130 using multi-power and gain-boosting techniques may receive the first power sequence PSEQ1 of the first voltage VIN1 input through the first node 131, the second power sequence PSEQ2 of the second voltage VIN2 input through the second node 133, and the operation control signal EN and may analyze the first power sequence PSEQ1, the second power sequence PSEQ2, and the operation control signal EN in operation S110. According to the analysis result, the voltage regulator 130 may select the level of the gate voltage VG supplied to the gate 303 of the power transistor 600 and the level of the body voltage VB supplied to the body 601 of the power transistor 600, as described above with reference to FIGS. 1 through 10, in operation S120.

As described above, according to an exemplary embodiment of the inventive concept, a voltage regulator using multi-power and gain-boosting techniques boosts the gain of an error amplifier included in the voltage regulator using the gain-boosting technique, so that the voltage regulator operates normally even when a dropout voltage is very low. As a result, the voltage regulator increases or maximizes its power efficiency. In addition, when an electronic device includes the voltage regulator, the use time of a battery of the electronic device is increased and the outflow of energy due to power loss is prevented, which reduces heat generated in the electronic device.

While the inventive concept has been particularly shown and described with reference to exemplary embodiments thereof, it will be understood by those of ordinary skill in the art that various changes in forms and details may be made therein without departing from the spirit and scope of the inventive concept as defined by the following claims.

What is claimed is:

1. A voltage regulator, comprising:

an error amplifier configured to receive a first voltage through a first node as an operating voltage, to amplify a difference between a reference voltage and a feedback voltage, and to output an amplified voltage;

a power transistor connected between a second node through which a second voltage is supplied and an output node; and a switch circuit configured to select a level of a gate voltage supplied to a gate of the power transistor and a level of a body voltage supplied to a body of the power transistor in response to a first power sequence of the first voltage, a second power sequence of the second voltage, and an operation control signal.

2. The voltage regulator of claim 1, wherein the first voltage is higher than the second voltage.

3. The voltage regulator of claim 1, wherein when one of the first and second voltages is not powered up, the switch circuit selects a higher one of the first voltage and the second voltage as the gate voltage and the body voltage and disconnects the gate of the power transistor from an output node of the error amplifier.

4. The voltage regulator of claim 1, wherein when both of the first and second voltages are powered up and the operation control signal is disabled, the switch circuit selects the first voltage or second voltage as the gate voltage and the body voltage and connects the gate of the power transistor to an output node of the error amplifier.

5. The voltage regulator of claim 1, wherein when both of the first and second voltages are powered up and the operation control signal is enabled, the switch circuit selects an output voltage of the error amplifier as the gate voltage and the second voltage as the body voltage.

6. The voltage regulator of claim 5, wherein the error amplifier outputs the amplified voltage using the first voltage as the operating voltage when the operation control signal is enabled and does not use the first voltage as the operating voltage when the operation control signal is disabled.

7. The voltage regulator of claim 1, wherein the switch circuit comprises:

a first switch circuit connected between an output node of the error amplifier and the gate of the power transistor;

a second switch circuit connected to the first node, the second node, and the gate of the power transistor; and a third switch circuit connected to the first node, the second node, and the body of the power transistor.

8. The voltage regulator of claim 7, wherein the first switch circuit controls a connection between the output node of the error amplifier and the gate of the power transistor in response to a power-on signal generated in response to the first power sequence and the second power sequence, the second switch circuit controls a connection between the first node and the gate of the power transistor and a connection between the second node and the gate of the power transistor in response to the power-on signal and the operation control signal, and the third switch circuit controls a connection between either of the first and second nodes and the body of the power transistor in response to the power-on signal and the operation control signal.

9. The voltage regulator of claim 8, wherein each of the first through third switch circuits comprises a logic gate circuit configured to process at least one signal among the power-on signal and the operation control signal and the logic gate circuit uses a higher one of the first voltage and the second voltage as an operating voltage.

10. The voltage regulator of claim 1, wherein the error amplifier comprises:

an amplifier stage having a two-stage cascode architecture and configured to amplify the difference between the reference voltage and the feedback voltage; and an output stage having the two-stage cascode architecture and configured to output the amplified voltage from the amplifier stage to the switch circuit.

11. The voltage regulator of claim 10, wherein the output stage comprises:

a first feedback loop disposed at a pull-up path between the first node and an output node of the error amplifier; and a second feedback loop disposed at a pull-clown path between the output node of the error amplifier and a ground.

12. The voltage regulator of claim 11, wherein the error amplifier further comprises a third feedback loop disposed between the output node of the error amplifier and the ground and shares a part of the second feedback loop.

13. A mobile device, comprising:

a voltage regulator; and a power management integrated circuit configured to supply a first voltage to the voltage regulator through a first transmission line and to supply a second voltage to the voltage regulator through a second transmission line, wherein the voltage regulator comprises:

an error amplifier configured to receive the first voltage through a first node connected to the first transmission line as an operating voltage, to amplify a difference between a reference voltage and a feedback voltage, and to output an amplified voltage;

a power transistor connected between a second node connected to the second transmission line and an output node of the voltage regulator; and a switch circuit configured to select a level of a gate voltage supplied to a gate of the power transistor and a level of a body voltage supplied to a body of the power transistor in response to a first power sequence of the first voltage, a second power sequence of the second voltage, and an operation control signal.

14. The mobile device of claim 13, wherein the error amplifier comprises:

an amplifier stage having a two-stage cascode architecture and configured to amplify the difference between the reference voltage and the feedback voltage; and an output stage having a two-stage cascode architecture and configured to output the amplified voltage from the amplifier stage to the switch circuit.

15. The mobile device of claim 14, wherein the output stage comprises:

a first feedback loop disposed at a pull-up path between the first node and an output node of the error amplifier; and a second feedback loop disposed at a pull-down path between the output node of the error amplifier and a ground.

16. The mobile device of claim 13, wherein the switch circuit comprises:

a first switch circuit connected between an output node of the error amplifier and the gate of the power transistor;

a second switch circuit connected to the first node, the second node, and the gate of the power transistor; and a third switch circuit connected to the first node, the second node, and the body of the power transistor.

17. The mobile device of claim 16, wherein the first switch circuit controls a connection between the output node of the error amplifier and the gate of the power transistor in response to a power-on signal generated in response to the first power sequence and the second power sequence, the second switch circuit controls a connection between the first node and the gate of the power transistor and a connection between the second node and the gate of the power transistor in response to the power-on signal and the operation control signal, and the third switch circuit controls a connection between either of the first and second nodes and the body of the power transistor in response to the power-on signal and the operation control signal.

18. A mobile device, comprising:

a memory;

a memory controller comprising a voltage regulator; and a power management integrated circuit configured to supply a first voltage and a second voltage to the voltage regulator and to supply a third voltage to the memory, wherein the voltage regulator comprises:

an error amplifier configured to receive the first voltage through a first node as an operating voltage, to amplify a difference between a reference voltage and a feedback voltage, and to output an amplified voltage;

a power transistor connected between a second node receiving the second voltage and an output node of the voltage regulator; and a switch circuit configured to select a level of a gate voltage supplied to a gate of the power transistor and a level of a body voltage supplied to a body of the power transistor in response to a first power sequence of the first voltage, a second power sequence of the second voltage, and an operation control signal, and the first voltage is higher than the second voltage.

19. The mobile device of claim 18, wherein the error amplifier comprises:

an amplifier stage having a two-stage cascode architecture and configured to amplify the difference between the reference voltage and the feedback voltage; and an output stage having the two-stage cascode architecture and configured to output the amplified voltage from the amplifier stage to the switch circuit.

20. The mobile device of claim 19, wherein the switch circuit comprises:

a first switch circuit connected between an output node of the error amplifier and the gate of the power transistor;

a second switch circuit connected to the first node, the second node, and the gate of the power transistor; and a third switch circuit connected to the first node, the second node, and the body of the power transistor.

* * * * *